US008723907B2

(12) United States Patent
Takezawa

(10) Patent No.: US 8,723,907 B2
(45) Date of Patent: May 13, 2014

(54) IMAGE FORMING APPARATUS, WITH CONTROL UNIT CONFIGURED TO CONTROL A VALUE OF BIAS CURRENT

(75) Inventor: Satoru Takezawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 13/041,273

(22) Filed: Mar. 4, 2011

(65) Prior Publication Data

US 2011/0221847 A1 Sep. 15, 2011

(30) Foreign Application Priority Data

Mar. 9, 2010 (JP) ..... 2010-051869
Mar. 10, 2010 (JP) ..... 2010-053408
Jan. 27, 2011 (JP) ..... 2011-015343

(51) Int. Cl.
*B41J 2/435* (2006.01)
*B41J 2/47* (2006.01)

(52) U.S. Cl.
USPC ..... 347/237; 347/235; 347/236; 347/245; 347/246; 347/247

(58) Field of Classification Search
USPC ..... 347/235–237, 245–247
See application file for complete search history.

(56) References Cited

U.S. PATENT DOCUMENTS 5,061,949 A * 10/1991 Ogino et al. ..... 347/133
5,410,339 A * 4/1995 Bisaiji et al. ..... 347/140
5,767,888 A * 6/1998 Schleusener et al. ..... 347/130
6,160,569 A * 12/2000 Fujimori et al. ..... 347/262
6,259,466 B1 7/2001 Oomura
6,483,529 B1 * 11/2002 Ito et al. ..... 347/235
7,170,536 B2 * 1/2007 Inagawa et al. ..... 347/133
7,301,553 B2 * 11/2007 Koga et al. ..... 347/237
8,259,146 B2 * 9/2012 Fukamachi et al. ..... 347/236
2006/0227198 A1 * 10/2006 Ng ..... 347/112

FOREIGN PATENT DOCUMENTS

CN 1232975 A 10/1999
CN 101493661 A 7/2009
JP 11-245444 A 9/1999
JP 2001-281579 A 10/2001
JP 2008-258308 A 10/2008

* cited by examiner

*Primary Examiner* — Laura Martin
*Assistant Examiner* — Jeremy Bishop
(74) *Attorney, Agent, or Firm* — Canon U.S.A., Inc. IP Division

(57) ABSTRACT

Since a photodiode (PD) is disposed in the vicinity of the plurality of light emitting elements and, therefore, the PD also receives a laser beam emitted only by a bias current during the APC period, setting a bias current based on a result of light amount detection by the PD does not result in a bias current setting with sufficient accuracy. To solve this issue, an electrophotographic image forming apparatus forms an electrostatic latent image pattern on a photosensitive drum, and controls the value of the bias current set for a first light emitting element based on the potential of the electrostatic latent image pattern and a detecting result of the PD.

12 Claims, 21 Drawing Sheets

IMAGE FORMING APPARATUS, WITH CONTROL UNIT CONFIGURED TO CONTROL A VALUE OF BIAS CURRENT

BACKGROUND OF THE INVENTION

1. Field of the Invention

The present invention relates to controlling a bias current value for each of a plurality of light emitting elements in an electrophotographic image forming apparatus which forms an image on photosensitive members by using light beams emitted from the plurality of light emitting elements.

2. Description of the Related Art

An electrophotographic image forming apparatus such as a laser beam printer forms electrostatic latent images by scanning the surfaces of photosensitive members such as photosensitive drums by using laser beams emitted from a semiconductor laser and then developing the electrostatic latent images by using toner. With such an image forming apparatus, it is necessary to increase the ON/OFF switching speed of the semiconductor laser to deal with the increase in image resolution and operating speed in recent years. FIG. 14 illustrates a waveform (light intensity waveform) representing the intensity of a laser beam when the semiconductor laser is switched from the OFF state to the ON state. Referring to FIG. 14, the horizontal axis is assigned time. The solid line represents change in drive current supplied to a relevant light emitting element with time, and the dotted line represents change in light intensity (light amount) with time. Ideally, it is desirable that the waveform of the drive current (hereinafter referred to as drive current waveform) is identical or similar in shape to the light intensity waveform. However, as illustrated in FIG. 14, even when the drive current is supplied to the semiconductor laser, the light intensity waveform does not rise for a certain fixed period of time. Hereinafter, this phenomenon is referred to as degradation in light emission response of the semiconductor laser.

A semiconductor laser has the light emission characteristics as illustrated in FIG. 15A. Referring to FIG. 15A, the horizontal axis is assigned a drive current supplied to the semiconductor laser and the vertical axis is assigned a light emission amount (light intensity) of a laser beam corresponding to the supplied drive current value. As illustrated in FIG. 15A, the light emission amount increases slowly with respect to the increase in drive current value in a region where the drive current value supplied to the light emitting element is lower than a threshold current value Ith, and increases steeply with respect to the increase in drive current value in a region where the drive current value is higher than the threshold current value Ith.

To restrain the above-mentioned degradation in light emission response, the semiconductor laser is turned ON by supplying a bias current Ib instead of supplying a drive current from the OFF state in which no drive current is supplied to the semiconductor laser. The bias current Ib is set to such a value as to emit a laser beam having such a light amount that does not change the surface potential of a photosensitive member. When changing the surface potential of the photosensitive member, a drive current composed of the bias current Ib and a switching current Isw superimposed thereon is supplied to the semiconductor laser. Then, the semiconductor laser emits a laser beam having such an intensity that changes the surface potential of the photosensitive member. On the other hand, in a light emission wait state, only the bias current Ib is supplied to the semiconductor laser. Although the semiconductor laser enters a weak light emission state when the bias current Ib is supplied, the laser beam emitted from the semiconductor laser only by the bias current Ib has a low intensity and, therefore, the surface potential of the photosensitive member remains unchanged. Applying the bias current Ib to the semiconductor laser in a period for forming an electrostatic latent image on the photosensitive member in this way enables restraining the degradation in light emission response (light emission delay) when the switching current Isw is supplied to the semiconductor laser.

To restrain the degradation in light emission response, it is desirable to set the bias current value Ib to a value as close as possible to the drive current value for emitting a laser beam having such an intensity that changes the potential on the photosensitive member.

Japanese Patent Application Laid-Open No. 11-245444 discusses the following technique as a conventional method for setting the bias current Ib with sufficient accuracy. In automatic power control (hereinafter referred to as APC) for determining a drive current that achieves a constant light amount of laser beam, as illustrated in FIG. 15A, drive currents I1 and I2 are measured. The drive current I1 is a drive current necessary for light emission with a first light amount P1. The drive current I2 is a drive current necessary for light emission with a second light amount P2 which is lower than the first light amount P1 (for example, one fourth thereof) as a target value. The light amount of laser beam is measured by a photodiode (PD), and the drive current value supplied to the semiconductor laser at the time of image formation is controlled based on a result of light amount detection by the PD. The PD is disposed in the vicinity of the light emitting element at such a position where the PD receives the laser beam (rear beam) emitted in a direction opposite to the direction of the laser beam (front beam) toward the photosensitive member. When the semiconductor laser emits the front beam, it also emits the rear beam in response to the front beam emission. The intensity of the front beam has a relation (for example, a proportionality relation) with the intensity of the rear beam.

Referring to the graph in FIG. 15A, which represents a relation between the drive current and the light amount (light emission characteristics), a straight line connecting a point defined by the light amount P1 and the drive current I1 and a point defined by the light amount P2 and the drive current I2 is obtained. Then, an intersection of a line segment extending from the straight line and the horizontal axis (light amount zero) is obtained, and the current value for the intersection is set as the threshold current value Ith. Although the actual threshold current value Ith is a current value at which the inclination of the light emission characteristics changes in FIG. 15A, processing for grasping the light emission characteristics in detail is required to calculate the actual threshold current value Ith. To obtain the threshold current value Ith, it is necessary to turn ON the semiconductor laser by using at least three different light amounts, calculate these light amounts and current values corresponding thereto to obtain the light emission characteristics, and set the threshold current value Ith based on the light emission characteristics. However, this method takes much control time to obtain the threshold current value Ith.

Japanese Patent Application Laid-Open No. 11-245444 discusses a laser diode drive apparatus which sets a current value obtained by the above-mentioned method as the threshold current value Ith. The laser diode drive apparatus utilizes the fact that, when a high current value is supplied to the semiconductor laser, the light emission amount linearly changes with varying current value. The threshold current value Ith is multiplied by a predetermined coefficient $\alpha$, or a predetermined correction value is subtracted from the threshold current value Ith or added to the threshold current value Ith in order to obtain the bias current Ib. Setting the bias current Ib in this way enables preventing the emission of a laser beam having such an intensity that changes the potential on the photosensitive member from the semiconductor laser when only the bias current Ib is supplied.

Light emission with the first light amount P1 and light emission with the second light amount P2 are performed for every other scanning in this way. Thus, even when the threshold current value Ith varies by temperature change in the light emitting element, the bias current Ib can be set in relation to the variation in the threshold current value Ith.

However, in an image forming apparatus which exposes a photosensitive member to a plurality of laser beams emitted from a plurality of light emitting elements, detecting laser beams (rear beams) emitted from a plurality of light emitting elements by using one PD and performing APC based on a result of light amount detection intending to improve the image forming speed causes a problem that the bias current Ib cannot be set with high precision.

When performing APC, a drive current necessary for light emission with the first light amount P1 and a drive current necessary for light emission with the second light amount P2 are supplied to the light emitting element under control, and the bias current Ib corresponding to the light emitting element under control is calculated based on the above-mentioned conventional method. This control is sequentially performed during one scan for each of the plurality of light emitting elements.

In this case, the bias current Ib is supplied to light emitting elements other than the one under control to ensure proper light emission response. The bias current Ib is set before each scanning. Since the plurality of light emitting elements is disposed in the vicinity of the PD, the PD receives the laser beam emitted only by the bias current Ib. Therefore, the result of light amount detection by the PD includes the light amount emitting elements other than the one under control.

In the process for calculating the bias current value Ib based on the conventional method with such an image forming apparatus, a drive current I1' corresponding to the first light amount P1 and a drive current I2' corresponding to the second light amount P2 are calculated (refer to FIG. 15B). As a result of this calculation, as illustrated in FIG. 15B, a calculated threshold current value Ith' is lower than the proper threshold current value Ith, and accordingly the bias current value Ib is set to a value lower than the proper current value. With an image forming apparatus which forms an electrostatic latent image by using a plurality of light emitting elements, the bias current value Ib is set to a value remarkably lower than the threshold current value Ith in this way. This causes the degradation in the semiconductor laser response when the switching current Isw is supplied.

One of the possible solutions for this problem is to correct the calculated bias current value Ib so that it comes close to the threshold current value Ith. This correction is achieved by adding a correction value to the bias current value Ib or multiplying the bias current value Ib by a coefficient equal to or greater than one. However, the sensitivity (the ease with which the surface potential changes) of the photosensitive member fluctuates by a temperature or humidity change as well as the aging of a photosensitive layer of the photosensitive member. Therefore, when the bias current value Ib is corrected based on a fixed parameter (a correction value or coefficient), a latent image may be formed on the photosensitive member by a laser beam emitted from a light emitting element to which the corrected bias current value Ib is supplied.

SUMMARY OF THE INVENTION

According to an aspect of the present invention, an image forming apparatus includes a photosensitive member, a charging unit configured to charge the photosensitive member, a light source configured to emit a light beam for exposing the charged photosensitive member, wherein the light source includes a plurality of light emitting elements, a current supply unit configured to supply a drive current to the light source to cause the light source to emit the light beam, wherein the drive current includes a bias current, a potential detection unit configured to detect a potential of an electrostatic latent image formed on the photosensitive member exposed to the light beam, and a control unit configured to control a value of the bias current based on the potential detected by the potential detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
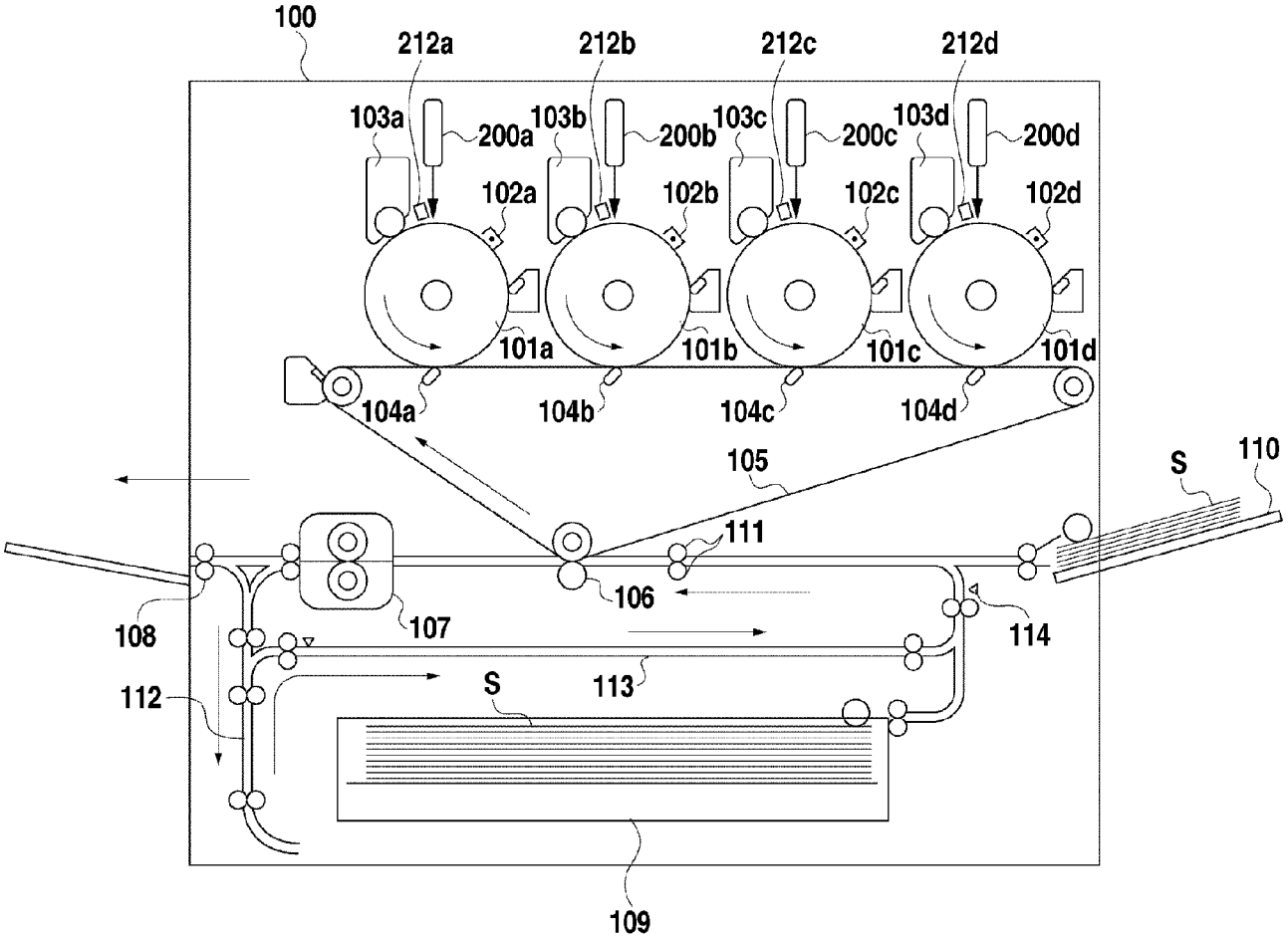
FIG. 1 is a sectional view illustrating an overall configuration of an image forming apparatus according to a first exemplary embodiment of the present invention.

FIG. 1 is a sectional view illustrating an overall configuration of an image forming apparatus 100 according to the first exemplary embodiment of the present invention, i.e., a schematic configuration diagram illustrating an electrophotographic full color printer. In the image forming apparatus 100 illustrated in FIG. 1, photosensitive drums 101*a* to 101*d* (photosensitive members) corresponding to each color are charged to a predetermined potential (charging potential) by respective charging devices 102*a* to 102*d*. On each of the charged photosensitive drums, an electrostatic latent image is formed by a laser beam emitted from each of optical scanning apparatuses 200*a* to 200*d* having a light emitting element (such as a semiconductor laser) as a light source. The electrostatic latent images on the photosensitive drums 101*a* to 101*d* are developed using toner by respective development units 103*a* to 103*d*. Then, the developed toner images of respective colors on the respective photosensitive drums 101*a* to 101*d* are transferred onto an intermediate transfer belt 105 by a transfer bias applied to respective transfer blades 104*a* to 104*d*. The four color toner images transferred onto the intermediate transfer belt 105 are collectively transferred onto a recording sheet S by a secondary transfer roller pair 106. Then, the recording sheet S bearing toner images thereon passes through a fixing device 107 for fixing processing. After the fixing processing is completed, the recording sheet S is discharged to the outside of the image forming apparatus 100 by a delivery roller pair 108.

The above-mentioned recording sheet S is fed from a sheet cassette 109 or a manual feed tray 110. A registration roller pair 111 is a pair of rollers for adjusting the timing for conveying the fed recording sheet S to the secondary transfer roller pair 106. At the time of two-sided printing, the recording sheet S, after passing through the fixing device 107, is led to a two-sided-reversing path 112, turned back for reversal, and then conveyed to a two-sided-printing path 113. After passing through the two-sided-printing path 113, the recording sheet S passes again through a vertical path roller pair 114, undergoes transfer of an image formed for the reverse side and fixing processing in a similar way to the front side, and then is discharged.

Figure 2A:
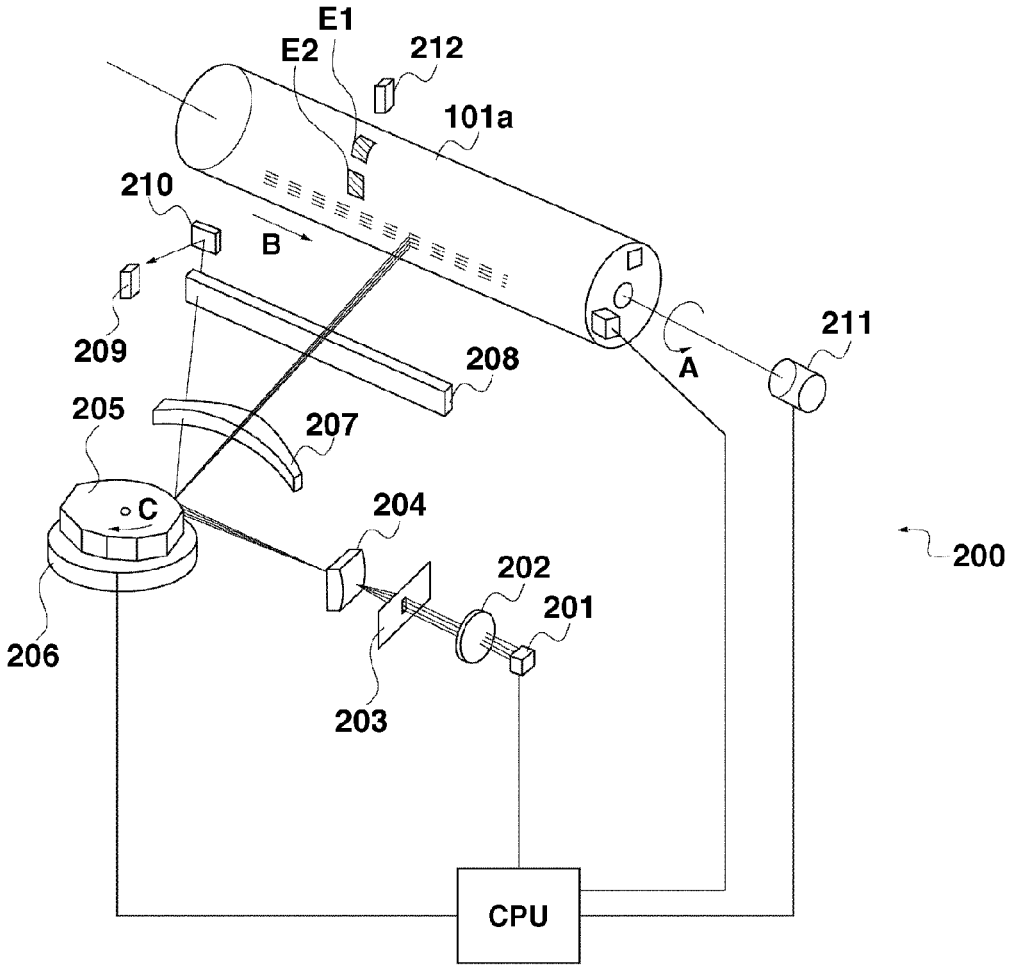
FIG. 2A is a schematic view illustrating an optical scanning apparatus and a photosensitive drum.

Since the four optical scanning apparatuses 200*a* to 200*d* are identical, only the optical scanning apparatus 200*a* and the photosensitive drum 101*a* will be described below. FIG. 2A is a schematic view illustrating the optical scanning apparatus 200*a* and the photosensitive drum 101*a*. The optical scanning apparatus 200*a* includes a semiconductor laser 201 (including laser diodes (LDs)) as a light source, a collimator lens 202, an aperture stop 203, a cylindrical lens 204, a polygon mirror 205, a polygon mirror drive unit 206, a toric lens 207, and a diffractive optical element 208.

The collimator lens 202 converts a laser beam emitted from the semiconductor laser 201 into a parallel light flux. The aperture stop 203 limits the light flux of the passing laser beam. The cylindrical lens 204 has predetermined refractive power only in the sub scanning direction. It forms an image of the light flux that has passed through the aperture stop 203 as an ellipse image on a reflection surface of the polygon mirror 205. The major axis of the ellipse image is in the main scanning direction. The polygon mirror 205 is rotated at a fixed speed in the direction denoted by an arrow C by the polygon mirror drive unit 206 to deflect (reflect) the laser beam imaged on the reflection surface of the polygon mirror 205. The toric lens 207 is an optical element having the fθ characteristics and has different refractive indices in the main and sub scanning directions. Both front and rear surfaces of the toric lens 207 in the main scanning direction have an aspherical shape. The diffractive optical element 208 is an optical element having the fθ characteristics and has different magnifications in the main and sub scanning directions. A beam detector (BD) 209 (a laser beam detection unit) is disposed at a position outside an image forming area on the photosensitive drum 101*a* of the image forming apparatus 100. The BD 209 detects a laser beam reflected by a reflective mirror 210 to generate a scanning timing signal (hereinafter referred to as a BD signal).

A spot of the laser beam deflected by a reflection surface of the rotatably driven polygon mirror 205 linearly moves on (scans) the surface of the photosensitive drum 101*a* in parallel with the drum axis. The optical scanning apparatus 200*a* according to the present exemplary embodiment includes the semiconductor laser 201 having a plurality of light emitting elements. The semiconductor laser 201 emits a plurality of laser beams to enable forming a plurality of linear electrostatic latent images with one scan. The photosensitive drum 101*a* is rotatably driven by a drive unit 211. With this rotation, the repetition of the main scanning with laser beams enables an image to be written in the sub scanning direction (rotational direction of the photosensitive drum 101*a*).

After the surface of the photosensitive drum 101*a* has been charged by the charging device 102*a*, the charged surface of the photosensitive drum 101*a* is exposed to the laser beam. The surface potential of the photosensitive drum 101*a* changes in response to the intensity of the radiated laser beam. The image forming apparatus 100 according to the present exemplary embodiment is provided with potential sensors 212 (212*a* to 212*d*) (potential detection units) for measuring the surface potential of respective photosensitive drums. The potential sensor 212 is disposed downstream of an exposure potential portion where the laser beam is radiated onto the photosensitive drum 101*a*, and upstream of a development portion where an electrostatic latent image is developed by toner in the rotational direction of the photosensitive drum 101*a*.

Referring to FIG. 2A, a first electrostatic latent image E1 (hereinafter referred to as first electrostatic latent image pattern) and a second electrostatic latent image E2 (hereinafter referred to as second electrostatic latent image pattern) are formed on the photosensitive drum 101*a*. These electrostatic latent image patterns E1 and E2 are formed to correct the bias current value Ib (described below). The potential on each of the electrostatic latent image patterns E1 and E2 is different from the charging potential on the photosensitive drum 101*a*.

The electrostatic latent image patterns E1 and E2 are formed in the sub scanning direction (rotational direction of the photosensitive drum 101*a*), so that they face the potential sensor 212 when calculating a correction value (described below).

Figure 2B:
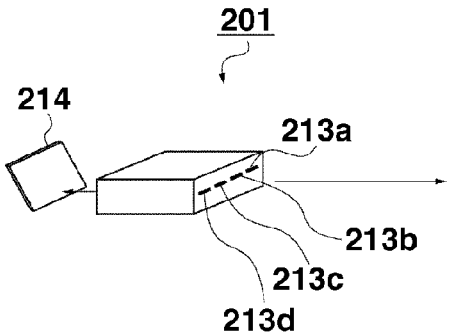
FIG. 2B is a schematic view illustrating a semiconductor laser.

FIG. 2B is a schematic view illustrating the semiconductor laser 201 in FIG. 2A. The semiconductor laser 201 according to the present exemplary embodiment includes at least two light emitting elements (first and second light emitting elements). FIG. 2B illustrates four light emitting elements 213*a* to 213*d*. Referring to FIG. 2B, the laser beam emitted in the rightward direction is the front beam led to the photosensitive drum 101*a*, and the laser beam emitted in the leftward direction in response to the front beam is the rear beam. A photodiode (PD) 214 is disposed at a position where the PD 214 receives the rear beam from the light emitting elements 213*a* to 213*d*. The PD 214 serves as a common light amount detection unit for the light emitting elements 213*a* to 213*d*. Automatic light amount control (described below) will be performed based on an output from the PD 214.

Figure 15A:
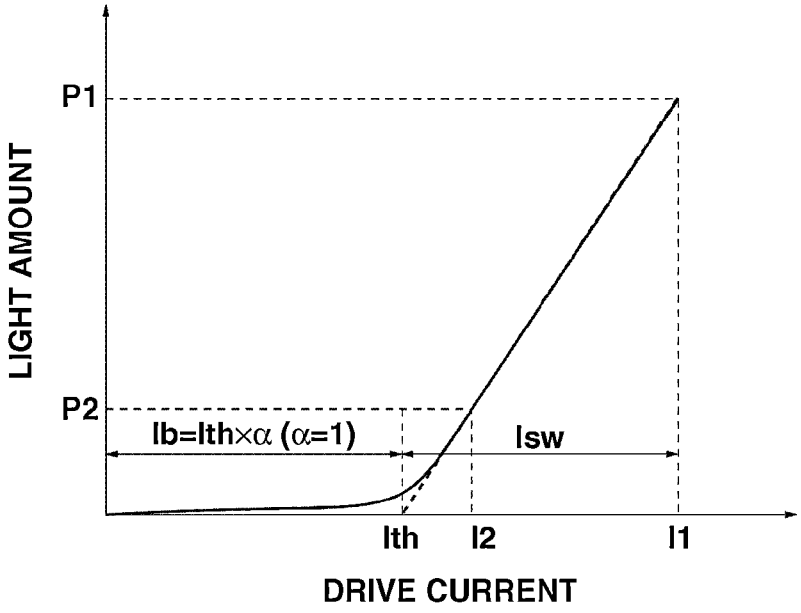
(PRIOR ART) FIG.15A
FIGS. 15A and 15B illustrate a conventional method for calculating a bias current.

The bias current Ib will be described below with reference to FIG. 15A. As illustrated in FIG. 15A, the light emission amount increases slowly with respect to the increase in drive current value in a region where the drive current value supplied to each light emitting element is lower than a threshold current value Ith, and increases steeply with respect to the increase in drive current value in a region where the drive current value is higher than the threshold current value Ith.

Taking advantage of such characteristics, the bias current Ib is supplied to light emitting elements included in a semiconductor laser of an electrophotographic image forming apparatus even when the charging potential on the photosensitive drum 101*a* is left unchanged when forming an electrostatic latent image. The bias current Ib corresponds to such a light amount that does not change the charging potential. When the charging potential on the photosensitive drum 101*a* is to be changed, a drive current composed of the bias current Ib and the switching current Isw superimposed thereon is supplied to the light emitting elements.

To set the bias current value Ib in the vicinity of the threshold current value Ith, a conventional image forming apparatus calculates the threshold current value Ith by using the method illustrated in FIG. 15A and then multiplies the calculated value by a predetermined coefficient $\alpha$ to obtain the bias current value Ib. In the present exemplary embodiment, the predetermined coefficient $\alpha$ is set to 1 so that the threshold current value Ith is set as the bias current value Ib. In the following descriptions, APC refers to control for setting the bias current value Ib.

When a semiconductor laser emits a laser beam, temperature rise occurs in the semiconductor laser itself and accordingly its light emission characteristics change. Specifically, a curved portion of the light emission characteristics illustrated in FIG. 15A vertically or horizontally shifts or the inclination of the straight portion thereof changes. To restrain the degradation in light emission response, it is desirable to frequently perform APC to set the bias current Ib suitable for the state of the semiconductor laser. Therefore, an electrophotographic image forming apparatus controls the bias current value Ib for each scanning.

Figure 3:
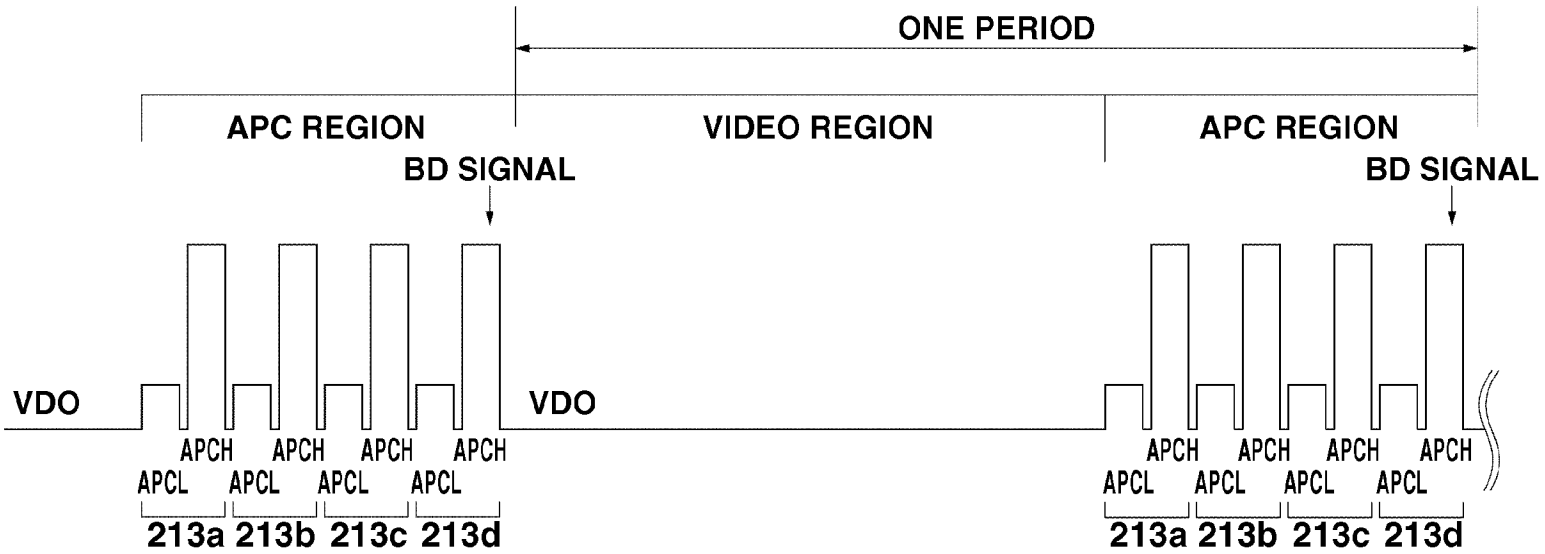
FIG. 3 is a timing chart of APC.

FIG. 3 is a timing chart illustrating APC. As mentioned above, APC is performed for each scanning by a laser beam. Specifically, APC is performed for each light emitting element in a period of the BD signal (described below). As illustrated in FIG. 3, APC is performed in the APC region, i.e., a period when the laser beam scans a non-image region. The APC region is included in one scanning period when the laser beam is deflected by one reflection surface of the polygon mirror 205. The waveform in FIG. 3 illustrates a current supplied to the semiconductor laser by an LD drive unit (described below). An image region collectively refers to scanning regions scanned by the laser beam, where an image based on input image data, a toner pattern for density adjustment, and a registration pattern for correcting color misregistration are formed. The non-image region collectively refers to regions other than the image region, out of the regions scanned by the laser beam.

Referring to FIG. 3, a video region where the photosensitive drum 101*a* is exposed to image data is the image region, and the APC region where APC is applied is the non-image region. APC is performed in a period when the laser beam is scanning the non-image region. A CPU (described below) determines which of the image region and the non-image region is being scanned by the laser beam by counting a clock signal at the timing of a BD signal output by the BD 209.

When performing APC, the LD drive unit supplies the drive current to each light emitting element. Although FIG. 3 illustrates such a waveform that supplies a fixed current, the drive current value actually varies because, during the APC period, drive current value search is performed so that a laser beam emitted from each light emitting element has the first light amount P1 and the second light amount P2. Although FIG. 3 illustrates a state where there is no waveform rising portion in the video region, the waveform rises in response to image data during this period.

FIG. 3 illustrates an exemplary APC sequence for each of the four light emitting elements 213*a* to 213*d*. First of all, APC is performed to cause the light emitting element 213*a* to emit a laser beam having the first light amount P1 and the second light amount P2. Then, APC is performed in a similar way for each of the light emitting elements 213*b*, 213*c*, and 213*d*. When performing APC, the CPU (described below) controls the timing of light emission by each light emitting element based on the timing of BD detection.

As illustrated in FIG. 3, the BD signal is generated by using a laser beam emitted from the light emitting element 213*d* during the APC period for the light emitting element 213*d*. Specifically, when performing APC for the light emitting element 213*d*, a drive current is supplied to the light emitting element 213*d* so that it emits a laser beam having the first light amount P1 and the second light amount P2. The BD signal is generated when a laser beam having the second light amount P2 emitted from the light emitting element 213*d* enters the BD 209.

With an image forming apparatus which forms an image by using a semiconductor laser having a plurality of light emitting elements, the following problem arises when setting the bias current value Ib by using the conventional method.

When performing APC, a drive current composed of the bias current Ib and the switching current Isw superimposed thereon is supplied to the light emitting element under APC, and the light emitting element emits a laser beam having a light amount corresponding to the drive current. On the other hand, only the bias current Ib is supplied to light emitting elements other than the light emitting element under control, and accordingly they emit a low-intensity laser beam. As illustrated in FIG. 2B, since the PD 214 is disposed in the vicinity of the four light emitting elements, the PD 214 also receives a laser beam emitted from light emitting elements other than the light emitting element under control only by the bias current Ib, and outputs a signal corresponding to a result of light amount detection. Therefore, a threshold current value Ith' calculated based on the output result of the PD 214 is lower than the threshold current value Ith (refer to FIG. 15B).

When APC is performed based on the output of the PD 214 disposed in the position illustrated in FIG. 2B with an image forming apparatus which forms an image in this way by using a semiconductor laser having a plurality of light emitting elements, the bias current value Ib is set to a value lower than a desired value. The result is degraded light emission response of the light emitting elements to image data (increase in amount of light emission delay).

To solve the above-mentioned problem, the image forming apparatus 100 according to the present exemplary embodiment calculates the correction value Icor for correcting the reference current value Ib' (a temporary bias current value before correction) calculated based on a result of light amount detection by the PD 214, and then sets a value corrected by the correction value Icor as the bias current value Ib.

The image forming apparatus 100 according to the present exemplary embodiment will be described in detail below. First of all, the reference current value Ib' (a temporary bias current value) for obtaining the bias current Ib based on a result of light amount detection by the PD 214 is calculated by using a similar method to that for the conventional image forming apparatus. Then, the image forming apparatus according to the present exemplary embodiment adds the correction value Icor (described below) to the reference current value Ib', and then sets the resultant value as the bias current value Ib.

Figure 4:
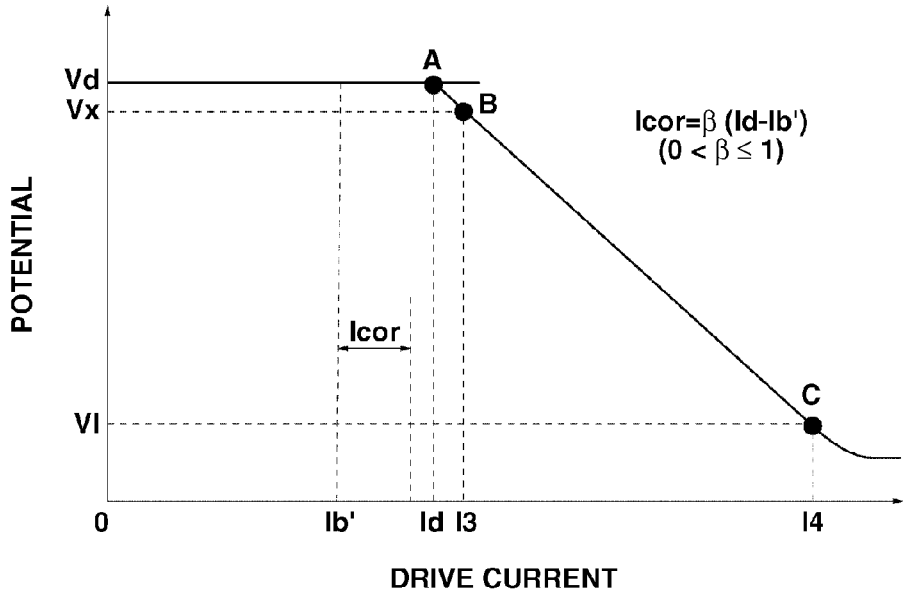
FIG. 4 illustrates a relation between a drive current value and a potential on the photosensitive drum.

The correction value Icor will be described below with reference to FIG. 4. FIG. 4 illustrates a relation between a drive current value and a potential on the photosensitive drum 101*a*. The vertical axis is assigned the potential on the photosensitive drum 101*a* and the horizontal axis is assigned the drive current value. The correction value Icor is calculated from the relation between the potential of the electrostatic latent image formed on the photosensitive drum 101*a* and the drive current. Referring to FIG. 4, Vd denotes the surface potential of the photosensitive drums 101*a* to 101*d* charged by the charging devices 102*a* to 102*d*, respectively. First of all, the first drive current I3 and the second drive current I4 having a value higher than the first drive current I3 are supplied to the first light emitting element (for example, the light emitting element 213*a*) to form the electrostatic latent image pattern E2 on the photosensitive drum 101*a*. Each of the drive currents I3 and I4 is composed of the reference current value Ib' and the switching current Isw superimposed thereon, the switching current Isw having different values for the drive currents I3 and I4.

The potential sensor 212 detects the potential of the electrostatic latent image patterns E1 and E2 formed on the photosensitive drum 101*a* by respective drive currents I3 and I4. FIG. 4 illustrates a relation between the drive current value I3 and the potential of the electrostatic latent image pattern formed by the drive current value I3 (point B), and a relation between the drive current value I4 and the potential of the electrostatic latent image pattern formed by the drive current value I4 (point C). Referring to FIG. 4, since the intensity of the laser beam emitted by the drive current I3 is higher than the intensity of the laser beam emitted by the drive current I4, a potential Vl of the electrostatic latent image formed by the drive current I4 is lower than a potential Vx of the electrostatic latent image formed by the drive current I3.

The potential produced by radiating a laser beam onto the surface of the charged photosensitive drum 101*a* changes almost in proportion to varying intensity (light amount) of the laser beam. Further, the intensity of the laser beam changes in proportion to varying drive current of the light emitting element. Therefore, the potential on the photosensitive drum 101*a* changes in proportion to varying drive current of the light emitting element. The CPU (described below) obtains a formula for a straight line connecting the points B and C. The CPU calculates the following formula (1) based on the potential and the drive current value corresponding thereto at the points B and C.

$$Y = \frac{1}{I3 - I4}\{(Vx - Vl)X + Vl \cdot I3 - Vx \cdot I4\} \tag{1}$$

Then, the CPU obtains a drive current value Id for an intersection (point A) of a straight line defined by the formula (1) and a straight line defined by Y=Vd.

$$Id = \frac{1}{Vx - Vl}\{(Vd - Vl)I3 + (Vx - Vd) \cdot I4\} \tag{2}$$

As mentioned above, Vd in FIG. 4 denotes a charging potential. Theoretically, the charging potential remains unchanged when the photosensitive drum 101*a* is not exposed to light. Therefore, even when a current up to the value for point A in FIG. 4 is supplied as the bias current Ib, no electrostatic latent image is formed on the photosensitive drum 101*a*. The drive current value Id is a minimum drive current value necessary to emit a laser beam having an intensity that can change the charging potential on the photosensitive drum 101*a* to form an electrostatic latent image thereon.

The image forming apparatus according to the present exemplary embodiment calculates the drive current value Id for the intersection (point A) of the straight line connecting the above-mentioned two points (B and C) and the straight line for Y=Vd, multiplies a difference between the drive current value Id and the reference current value Ib' by a predetermined coefficient β (0<β≤1), and then sets the resultant value as the correction value Icor (represented by formula (3) below). Then, the image forming apparatus adds the correction value Icor to the reference current value Ib' (represented by formula (4)), and then sets the resultant value as the bias current value Ib. Correcting the bias current value Ib in this way enables setting the bias current value Ib to a value less than and close to the minimum drive current value necessary to emit a laser beam having such an intensity that can change the charging potential on the photosensitive drum 101*a*.

$$Icor = \beta(Id - Ib') \tag{3}$$

$$Ib = Ib' + Icor \tag{4}$$

When the sensitivity of the photosensitive drum 101*a* rises (high sensitivity state), setting the bias current Ib by adding the correction value Icor to the reference current value Ib' without the multiplication by the correction coefficient β may form an electrostatic latent image by a laser beam emitted from a light emitting element by the bias current Ib. Therefore, the image forming apparatus according to the present exemplary embodiment multiplies the difference between the drive current value Id and the reference current value Ib' by the predetermined coefficient β (0<β≤1).

The threshold current value Ith is calculated based on a result of light amount detection by the PD 214. As illustrated in FIG. 15A, according to the light emission characteristics of a semiconductor laser, the light amount linearly increases with increasing drive current value equal to or greater than the threshold current value Ith. Therefore, the threshold current value Ith obtained from a result of light amount detection by the PD 214 will never exceed the above-mentioned minimum value.

Electrostatic latent image patterns E1 and E2 cannot be formed for each scanning. The sensitivity of the photosensitive drum 101*a* fluctuates by the aging and variation in relevant environmental conditions (a temperature and humidity). Therefore, it is desirable to calculate the correction value Icor at predetermined timings: when the power is turned ON, when returning from the standby state, when the accumulative number of image-formed recording sheets S reaches a predetermined number, when the number of continuously image-formed recording sheets S reaches a predetermined number, and when the number of image-formed recording sheets S after the power is turned ON reaches a predetermined number. When the number of continuously image-formed recording sheets S reaches a predetermined number, and when the number of image-formed recording sheets S after the power is turned ON reaches a predetermined number, the electrostatic latent image patterns E1 and E2 are formed at a portion between recording sheets S. Obtaining the correction value at the above-mentioned timings enables calculating the correction value Icor according to the sensitivity of the photosensitive drum 101*a*.

Figure 5:
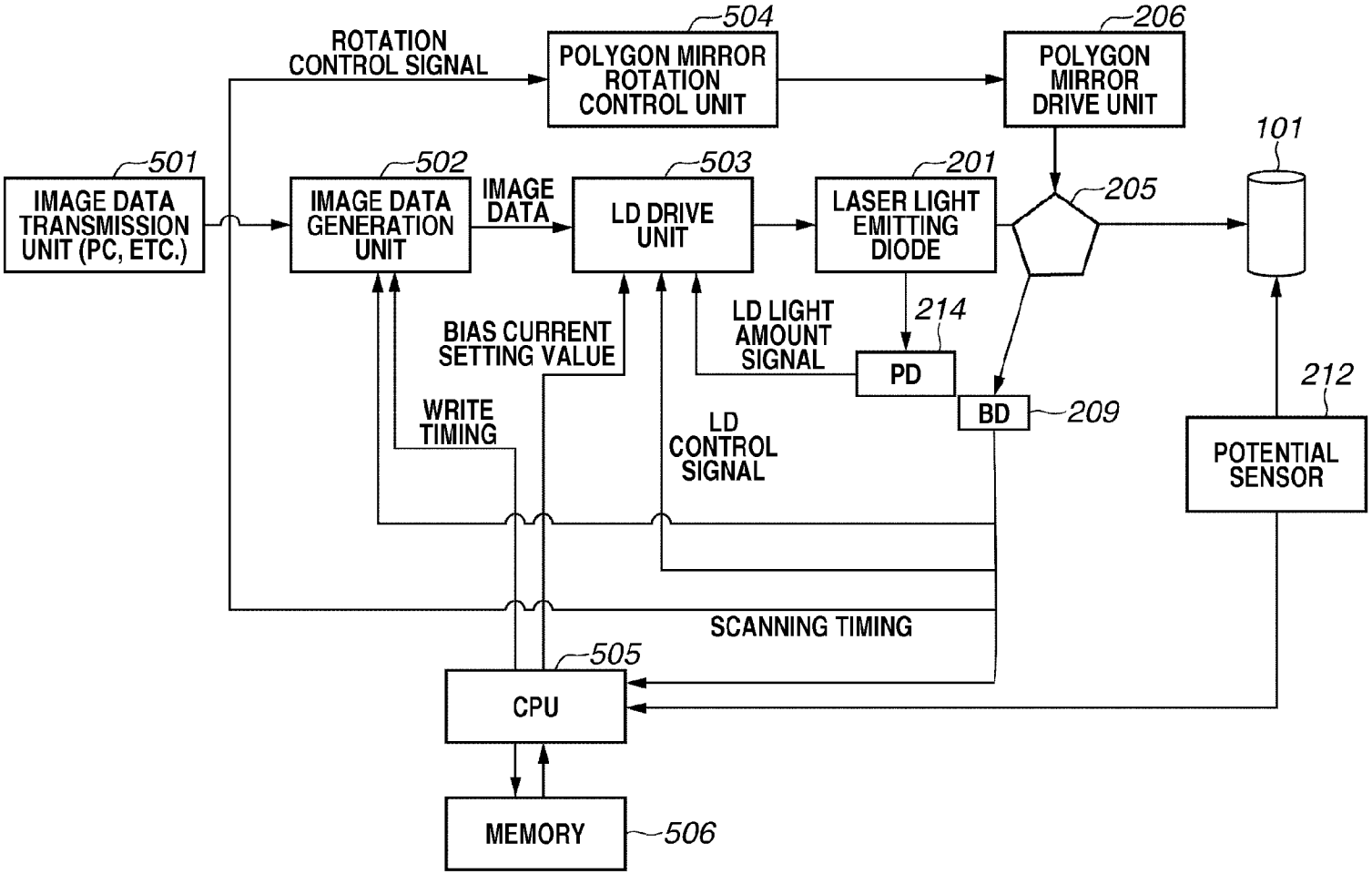
FIG. 5 is a control block diagram illustrating the image forming apparatus according to the first exemplary embodiment.

FIG. 5 is a control block diagram illustrating an image forming apparatus which performs control for calculating the correction value Icor. The image data transmission unit 501 such as a PC transmits to the image data generation unit 502 input image data for an image to be printed. The image data generation unit 502 applies image processing to the input image data and generates a pulse width modulation (PWM) signal for emitting a laser beam from each light emitting element. The PWM signal (drive current) is composed of the bias current Ib and the switching current (modulation current) superimposed thereon.

The optical scanning apparatus 200 includes the BD 209. After the BD 209 generates a synchronization signal, the LD drive unit 503 (a current supply unit) outputs the PWM signal to each light emitting element of the semiconductor laser 201 at a predetermined timing. Each light emitting element turns ON and OFF based on the PWM signal.

The LD drive unit 503 controls the current values (the bias current Ib and the switching current Isw) to be supplied to each light emitting element so that it emits a laser beam having a predetermined light amount (intensity) based on the PWM signal.

The polygon mirror 205 is rotatably driven by the polygon mirror drive unit 206. A polygon mirror rotation control unit 504 inputs the synchronization signal from the BD 209 and outputs an acceleration signal or a deceleration signal to the polygon mirror drive unit 206 so that the BD signal is generated at predetermined intervals.

The potential sensor 212 disposed in the vicinity of the photosensitive drum 101*a* measures the potential of the above-mentioned electrostatic latent image pattern. When an electrostatic latent image is formed by radiating a laser beam onto the photosensitive drum 101*a* charged to a predetermined potential by the respective charging device, the charging potential on the surface of the photosensitive drum 101*a* changes accordingly. The potential sensor 212 illustrated in FIGS. 2 and 5 measures the surface potential of the photosensitive drum 101*a* and then transmits the measured data to the CPU 505. The CPU 505 calculates the correction value Icor based on the measured data and then stores the correction value Icor in the memory 506 (a storage unit).

The CPU 505 performs APC for each light emitting element in the non-image region. The CPU 505 adds the correction value Icor to the reference current value Ib' calculated based on a result of light amount detection by the PD 214, and then sets the resultant value as the bias current Ib. In the image region immediately following the non-image region, the bias current Ib set therein is supplied to each light emitting element.

Figure 6:
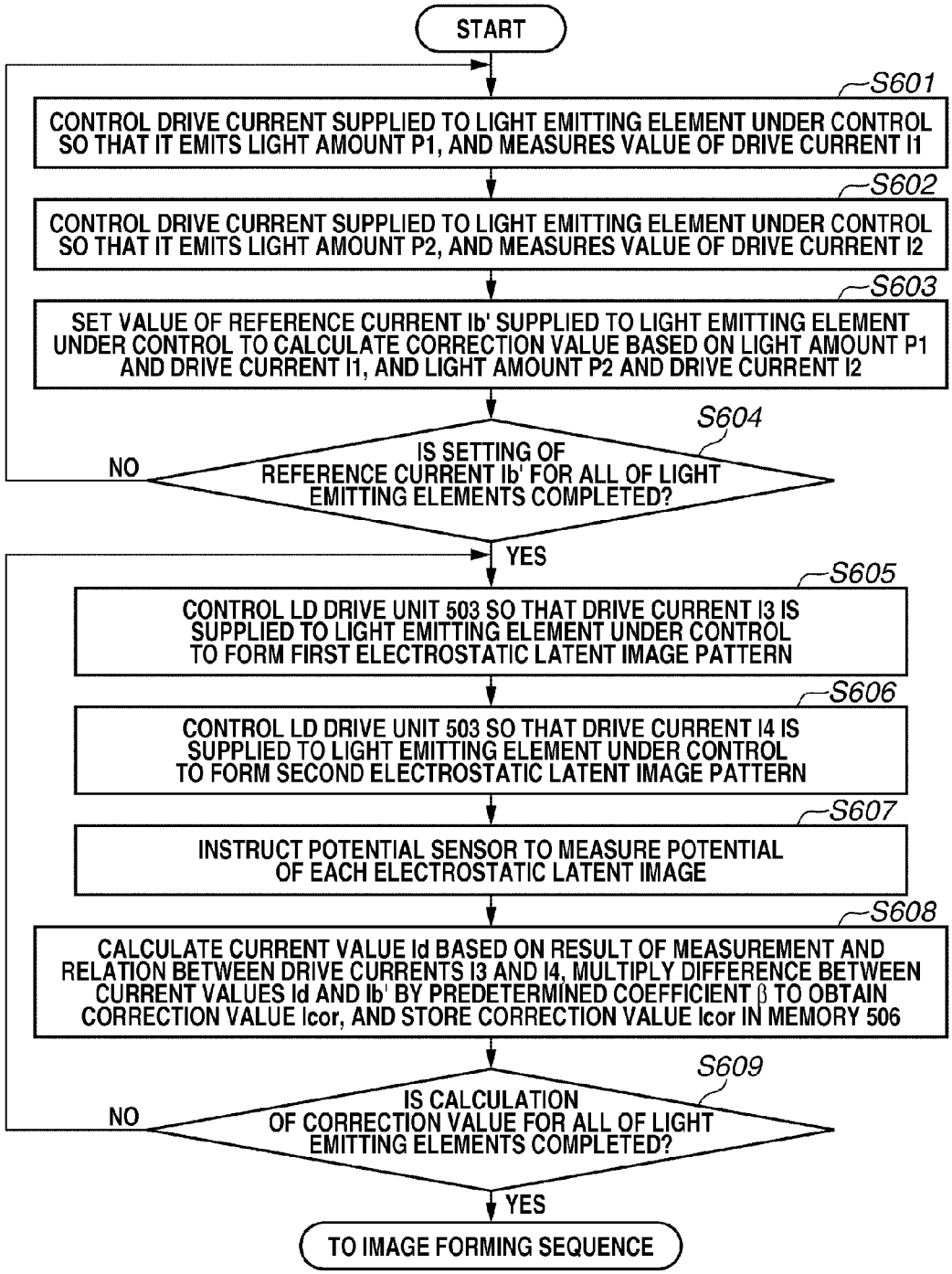
FIG. 6 is a flowchart illustrating control performed by a central processing unit (CPU) to calculate a correction value.

FIG. 6 is a flow chart illustrating control performed by the CPU 505 to calculate the correction current Icor. This control will be described below based on a case where the control is started at a timing of image data input when the image forming apparatus is in the standby state.

Figure 14:
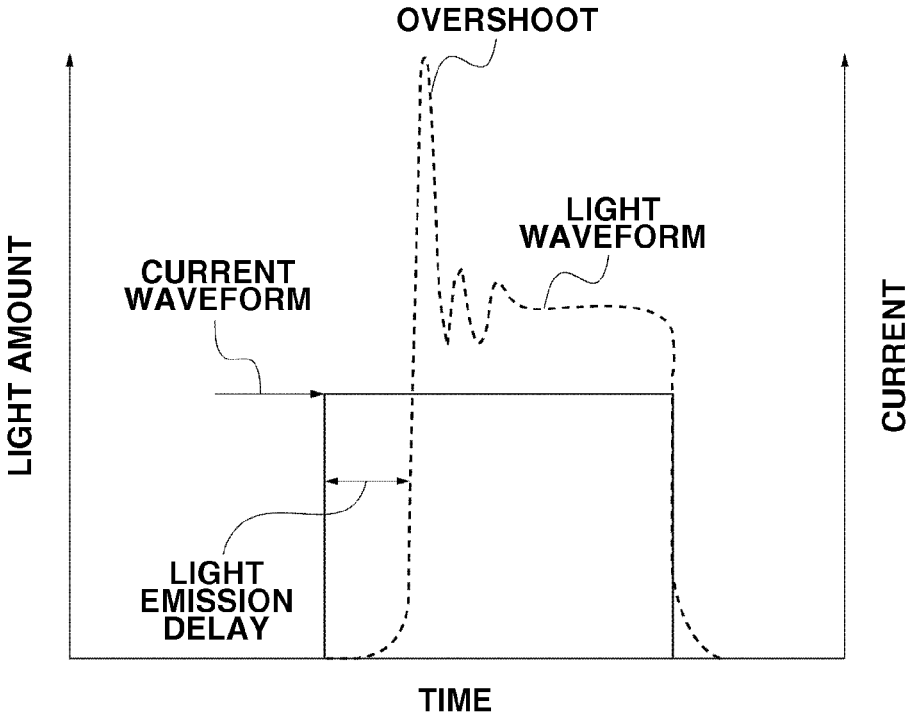
FIG. 14 illustrates a varying light amount emitted from the light emitting element when a bias current and a switching current superimposed thereon are supplied.
Figure 15B:
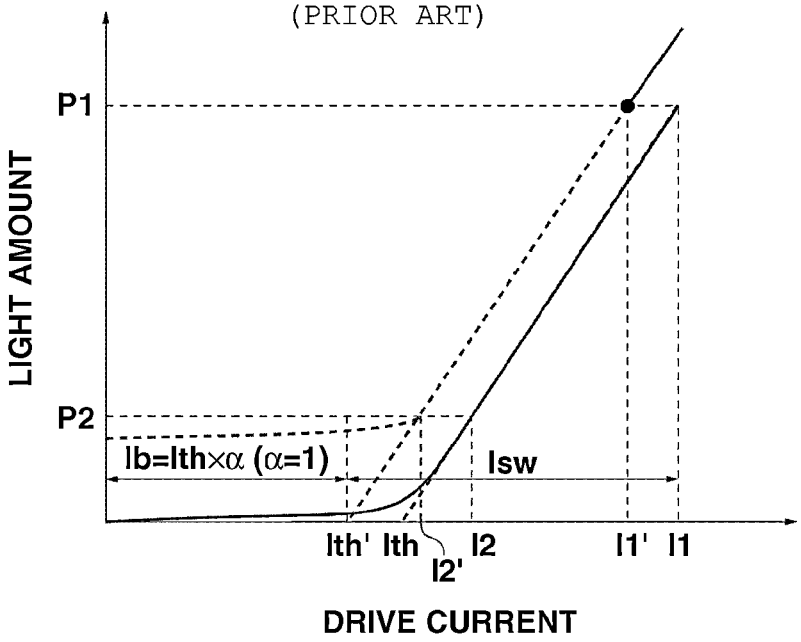
FIG.15B (PRIOR ART)

In steps S601 to S604, the CPU 505 performs control for setting the reference current value Ib' necessary to drive each light emitting element. In step S601, the CPU 505 controls the drive current to be supplied to the light emitting element under control so that it emits a laser beam having the light amount P1 as illustrated in FIG. 15B, and measures the drive current value I1. It is also possible to measure a light amount P of the laser beam emitted from the light emitting element under control when a predetermined drive current is supplied. In step S602, the CPU 505 controls the drive current to be supplied to the light emitting element under control so that it emits a laser beam having the light amount P2 as illustrated in FIG. 14, and measures the drive current value I2.

In step S603, the CPU 505 sets the reference current value Ib' to be supplied to the light emitting element under control to calculate the correction value Icor based on the light amount P1 and the drive current I1, and the light amount P2 and the drive current I2. The method for calculating the bias current Ib is similar to that in the above-mentioned conventional technique. In step S604, the CPU 505 determines whether setting of the reference current value Ib' used to calculate the correction value Icor is completed for all of the light emitting elements. When setting of the reference current value Ib' is completed for all of the light emitting elements (YES in step S604), the processing proceeds to step S605. Otherwise, when setting of the reference current value Ib' is not completed for all of the light emitting elements (NO in step S604), the processing returns to step S601 to perform control for similarly setting the reference current value Ib' for light emitting elements for which setting of the reference current value Ib' is not completed.

In steps S605 to S609, the CPU 505 enters a control mode for calculating the correction value Icor corresponding to each light emitting element. In step S605, the CPU 505 controls the LD drive unit 503 to supply the drive current I3 to the light emitting element under control (first light emitting element). In this case, the drive current I3 composed of the reference current value Ib' (the current value for the origin in the graph in FIG. 4) set in step S603 and a switching current superimposed thereon is supplied to each light emitting element. Accordingly, the first electrostatic latent image pattern is formed on the photosensitive drum 101*a* by a laser beam emitted from the light emitting element under control. The reference current value Ib' set in step S603 is supplied to light emitting elements (second light emitting element) other than the light emitting element under control.

In step S606, the CPU 505 controls the LD drive unit 503 to supply the drive current I4 to the light emitting element under control. In this case, the drive current I4 composed of the reference current value Ib' set in step S603 and a switching current superimposed thereon is supplied to the light emitting element under control, the switching current having a higher value than the switching current superimposed in step S605. Accordingly, the second electrostatic latent image pattern is formed on the photosensitive drum 101*a* by a laser beam emitted from the light emitting element under control. In step S607, the CPU 505 instructs the potential sensor 212 to measure the potential of each electrostatic latent image. In step S608, the CPU 505 calculates the drive current value Id based on a result of the potential measurement and a relation between the drive currents I3 and I4, multiplies a difference between the current values Id and Ib' by a predetermined coefficient β to obtain the correction value Icor, and stores the correction value Icor in the memory 506 for each light emitting element. In step S609, the CPU 505 determines whether calculation of the correction value Icor is completed for all of the light emitting elements. When calculation of the correction value Icor is completed for all of the light emitting elements (YES in step S609), the processing proceeds to the image forming sequence. Otherwise, when calculation of the correction value Icor is not completed for all of the light emitting elements (NO in step S609), the processing returns to step S605 to calculate the correction value Icor for light emitting elements for which calculation of the correction value Icor is not completed.

The image forming sequence performed by the CPU 505 will be described below. In the image forming sequence, the CPU 505 performs APC at a timing illustrated in FIG. 3 and calculates the reference current value Ib' for each light emitting element. The CPU 505 adds the correction value Icor stored in the memory 506 in step S608 to the reference current value Ib', and then sets the resultant value as the bias current value Ib. Then, the CPU 505 supplies the bias current value Ib to each light emitting element in the subsequent video region.

Figure 7:
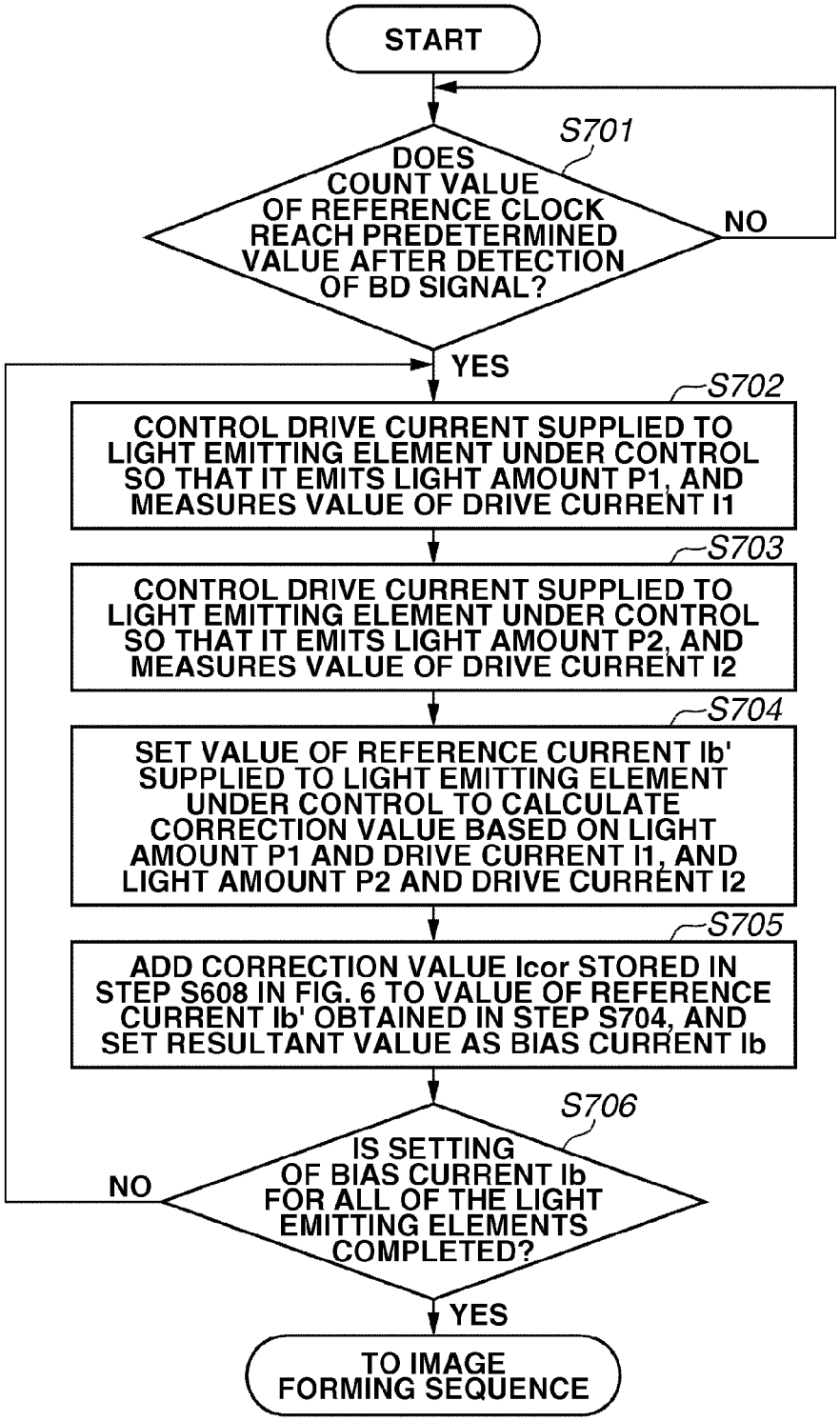
FIG. 7 is a flowchart illustrating control performed by the CPU in a non-image region at the time of image forming.

The control flow performed by the CPU 505 will be described below with reference to FIG. 7. The CPU 505 performs this control in the non-image region. During the image-forming period, the CPU 505 repeats the same control sequence for each scanning. In step S701, the CPU 505 determines whether the count value of the reference clock after BD signal generation has reached a predetermined count value. A count value corresponding to the non-image region is stored in the memory 506 as the predetermined count value. At a timing when the count value of the reference clock has reached the predetermined count value, a laser beam keeps scanning the non-image region until a subsequent BD signal is generated after one scanning period of the laser beam. When the CPU 505 determines that the count value of the reference clock has reached the predetermined count value (YES in step S701), the processing proceeds to step S702. In step S702, the CPU 505 supplies a current to the light emitting element under control so that it emits a laser beam having the light amount P1 illustrated in FIG. 15B, and measures the drive current value I1. In step S703, the CPU 505 supplies a current to the light emitting element under control so that it emits a laser beam having the light amount P2 illustrated in FIG. 15B, and measures the drive current value I2. In step S704, the CPU 505 sets the reference current value Ib' to be supplied to the light emitting element under control to calculate the correction value Icor based on the light amount P1 and the drive current I1, and the light amount P2 and the drive current I2.

In step S705, the CPU 505 adds the correction value Icor stored in step S608 in FIG. 6 to the reference current value Ib', and then sets the resultant value as the bias current Ib. In step S706, the CPU 505 determines whether setting of the bias current value Ib is completed for all of the light emitting elements. When setting of the bias current value Ib is completed for all of the light emitting elements (YES in step S706), the processing proceeds to the image forming sequence. Specifically, the CPU 505 enters a control mode for scanning the image region by using a laser beam. Otherwise, when setting of the bias current value Ib is not completed for all of the light emitting elements (NO in step S706), the processing returns to step S702 to perform APC for light emitting elements for which setting of the bias current value Ib is not completed.

As mentioned above, the bias current Ib can be set with sufficient accuracy by adding the correction value Icor to the current value calculated based on a result of light amount detection by the PD 214.

Figure 8:
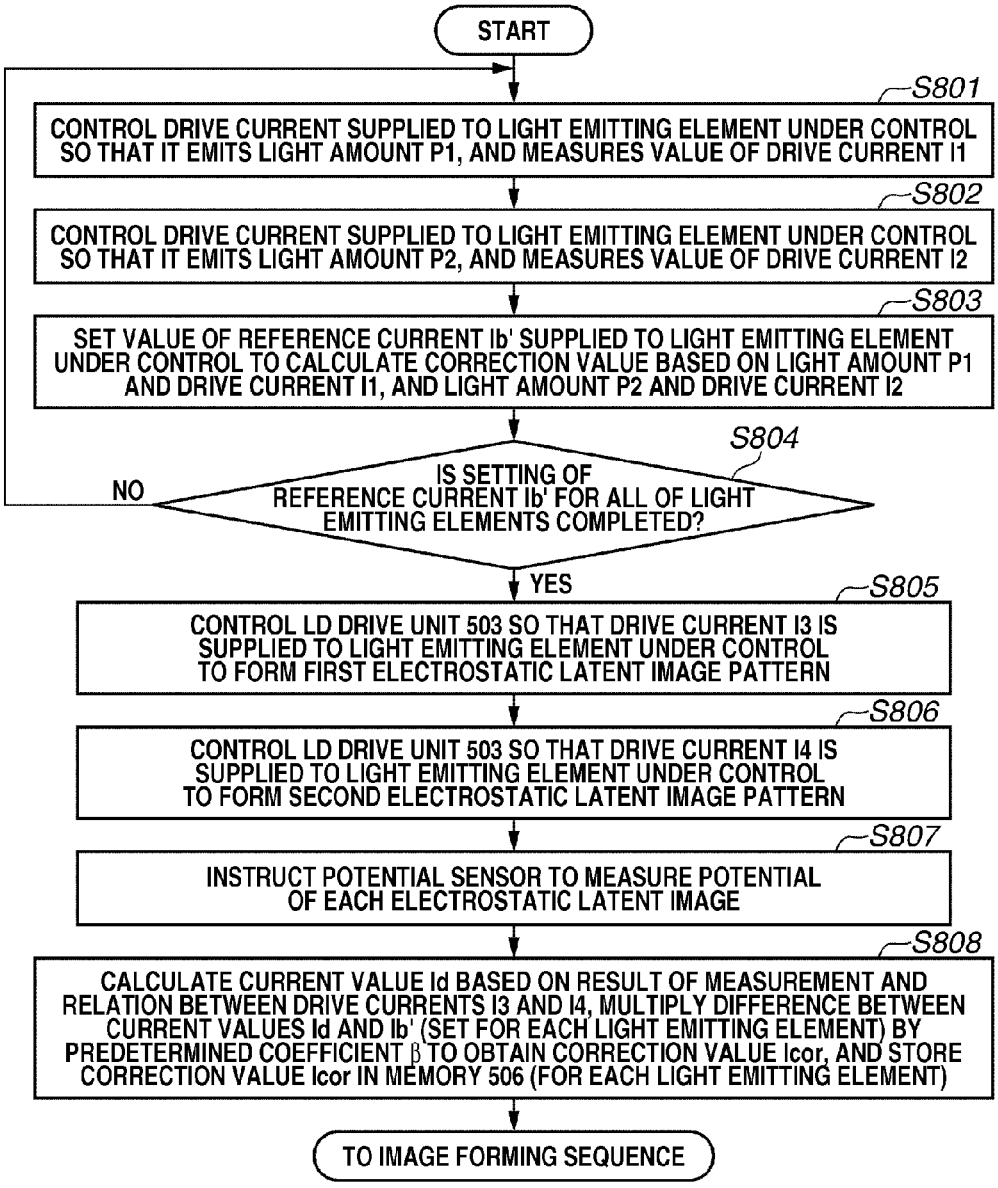
FIG. 8 is a flowchart illustrating an exemplary other control performed by the CPU to calculate a correction value.

The control flow illustrated in FIG. 6 may be changed as illustrated in FIG. 8. In the control illustrated in FIG. 6, the electrostatic latent image patterns E1 and E2 are formed by separately turning ON each light emitting element. Specifically, at least two electrostatic latent image patterns will be formed for each light emitting element.

On the other hand, in control illustrated in FIG. 8, the predetermined drive current I3 is supplied to at least two light emitting elements to form the electrostatic latent image pattern E1, and the predetermined drive current I4 is supplied to at least two light emitting elements to form the electrostatic latent image pattern E2. The following describes an example in which the drive currents I3 and I4 are supplied to all of the light emitting elements. Laser beams emitted from the light emitting elements 213*a* to 213*d* scan different positions on the photosensitive members during one scan. Therefore, when an electrostatic latent image pattern is formed as illustrated in FIG. 6, since an electrostatic latent image pattern will be formed only by a laser beam emitted by one light emitting element, the potential on the photosensitive drum 101*a* does not decrease to such an extent that the reduction can be detected by the potential sensor 212.

As illustrated in the control flow in FIG. 8, the electrostatic latent image patterns E1 and E2 are formed by using at least a plurality of light emitting elements to obtain the drive current value Id for point A. Steps S801 to S804 are similar to steps S601 to S604 and, therefore, explanations will be omitted.

In step S805, the CPU 505 controls the LD drive unit 503 to supply the drive current I3 to each light emitting element under control to form the electrostatic latent image pattern E1. In step S806, the CPU 505 controls the LD drive unit 503 to supply the drive current I4 to each light emitting element to form the electrostatic latent image pattern E2. In step S807, the CPU 505 instructs the potential sensor 212 to measure the potential of each electrostatic latent image. In step S808, the CPU 505 calculates the drive current value Id based on a result of potential measurement and a relation between the drive currents I3 and I4, multiplies a difference between the drive current value Id and the current value Ib' (set for each light emitting element in steps S801 to S803) by a predetermined coefficient β to obtain the correction value Icor, and stores the correction value Icor in the memory 506 for each light emitting element. Then, the processing proceeds to the image forming sequence. Specifically, the control flow in FIG. 8 differs from the control flow in FIG. 6 in that a common drive current is used as a drive current for point A to calculate the correction value Icor for each light emitting element.

As mentioned above, the light emission characteristics of a semiconductor laser change by temperature change in a semiconductor laser, and the threshold current value Ith also varies accordingly. For example, when the semiconductor laser emits a laser beam during one scanning, the light emission characteristics change before and after the one scanning and the threshold current value Ith also varies accordingly. When the threshold current value Ith varies, the point A in FIG. 4 horizontally moves following the variation in threshold current value Ith. Specifically, when the threshold current value Ith varies, the minimum drive current value necessary to emit a laser beam having such an intensity that changes the potential on the photosensitive drum 101*a* also changes following the variation in threshold current value Ith. Therefore, in the present exemplary embodiment, the reference current value Ib' is calculated for each scanning and the correction value Icor (fixed parameter) is added to the reference current value Ib'.

Since the drive current value Id is the minimum drive current value necessary to emit a laser beam having such an intensity that changes the potential on the photosensitive drum 101*a*, it is desirable to apply the drive current value Id as the bias current value Ib for restraining the degradation in light emission response. However, it takes time to form an electrostatic latent image pattern, detect the potential of the electrostatic latent image pattern, and feed back the bias current value Ib based on a result of potential detection. However, during the image-forming period, scanning by laser beam is performed at high speed and therefore sufficient time for performing the feedback control cannot be ensured.

Therefore, the image forming apparatus according to the present exemplary embodiment first calculates the correction value Icor during the non-image-forming period. Then, the bias current value Ib is obtained by adding the correction value Icor to the reference current value Ib' (a temporary bias current Ib') calculated by the conventional method for calculating the bias current Ib during the image-forming period. Then, the bias current value Ib is set to a value as close as possible to the minimum drive current value necessary to emit a laser beam having such an intensity that changes the potential on the photosensitive drum 101*a*. The image forming apparatus according to the present exemplary embodiment controls the bias current Ib based on a result of potential detection for the electrostatic latent image pattern. This enables controlling with high precision the bias current value Ib for each of a plurality of light emitting elements in a light source, thus restraining the degradation in light emission response when the switching current Isw is supplied to each light emitting element.

Figure 9A:
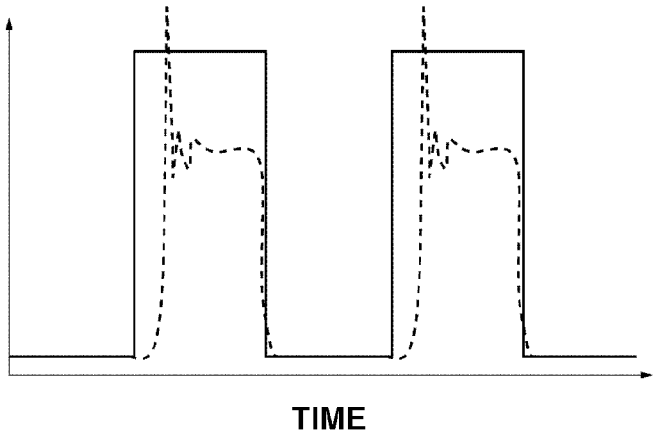
FIG. 9A illustrates a varying light amount emitted from a light emitting element when a switching current is supplied and a bias current is not.
Figure 9B:
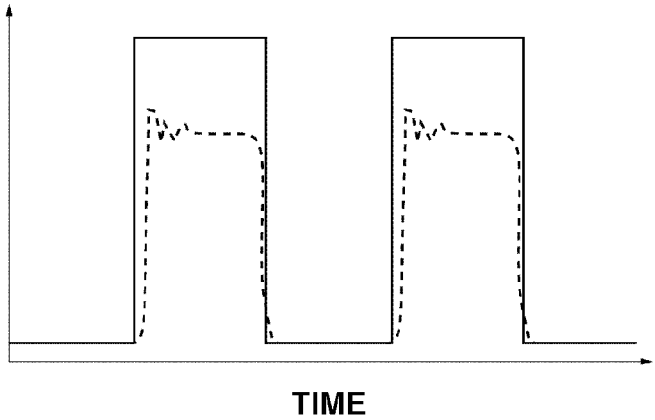
FIG. 9B illustrates a varying light amount emitted from the light emitting element when a bias current and a switching current superimposed thereon are supplied.

The method for setting the bias current Ib according to the present exemplary embodiment can restrain not only the degradation in light emission response but also an overshooting of the light amount of laser beam (hereinafter referred to as light amount overshooting). FIG. 9A illustrates a varying light amount emitted from a light emitting element when the switching current Isw is supplied thereto and the bias current Ib is not. On the other hand, FIG. 9B illustrates a varying light amount emitted from the light emitting element when the bias current Ib and the switching current Isw superimposed thereon are supplied thereto. Referring to FIGS. 9A and 9B, the solid line denotes the switching current Isw supplied to the light emitting element and the dotted line denotes the light emission amount.

When the bias current Ib is not supplied to the light emitting element, as illustrated in FIG. 9A, a delay in light emission timing (a light emission delay) arises with respect to a timing of supplying the switching current Isw. The amount of light emission delay in FIG. 9A is greater than the amount of light emission delay in FIG. 9B where the bias current Ib is supplied. When the bias current Ib is not supplied to the light emitting element as illustrated in FIG. 9A, light amount overshooting (a temporary increase in light amount exceeding a predetermined light amount) arises. The amount of light amount overshooting in FIG. 9A is greater than the amount of light amount overshooting in FIG. 9B where the bias current Ib is supplied. When light amount overshooting arises, the potential on the charged photosensitive drum 101*a* changes more greatly than a predetermined potential change. This causes an increase in amount of toner used to develop an electrostatic latent image, resulting in a difference between the density of a document image and the density of an output image.

Setting the bias current value Ib to a value closer to the threshold current value Ith restrains to further extent the amount of light emission delay and the amount of light amount overshooting. Therefore, setting the bias current value Ib with the above-mentioned method enables restraining variation in image density due to the light emission delay and the light amount overshooting.

The first exemplary embodiment has specifically been described based on a method for setting the bias current Ib by using the correction value Icor calculated from a result of potential detection for an electrostatic latent image pattern formed on the photosensitive drum 101*a*. A second exemplary embodiment of the present invention will be described below based on a method for calculating the correction value Icor based on the density of a toner image developed from an electrostatic latent image pattern by using toner. In the following descriptions, elements having the same function as those in the first exemplary embodiment are assigned the same reference numeral.

Figure 10:
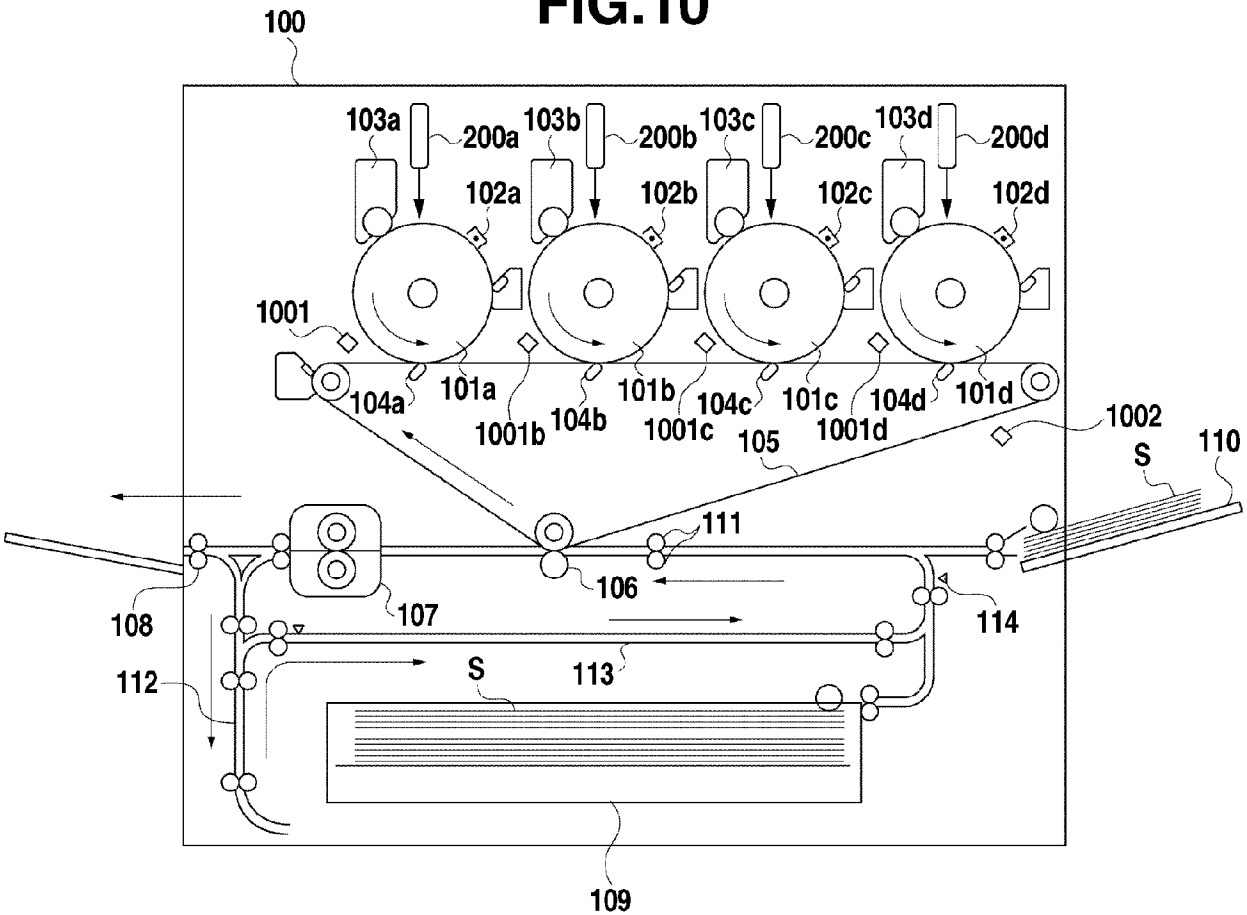
FIG. 10 is a sectional view illustrating an overall configuration of an image forming apparatus according to a second exemplary embodiment of the present invention.

FIG. 10 is a sectional view illustrating an image forming apparatus according to the second exemplary embodiment. The image forming apparatus in FIG. 10 differs from the image forming apparatus in FIG. 1 in that density sensors 1001*a* to 1001*d* (or a density sensor 1002) for detecting the density of toner images are provided. The density sensors 1001*a* to 1001*d* detect the density of toner images formed on the photosensitive drums 101*a* to 101*d*, respectively. The density sensors 1001*a* to 1001*d* are disposed downstream of the development units 103*a* to 103*d* and upstream of respective primary transfer portions (portions at which toner on respective photosensitive drums is transferred onto the intermediate transfer belt 105) in the rotational direction of the photosensitive drums 101*a* to 101*d*, respectively. The density sensor 1002 (a density detection unit) detects the density of a toner image transferred onto the intermediate transfer belt 105 (an image bearing member). The density sensor 1002 is disposed in the vicinity of the intermediate transfer belt 105, downstream of the primary transfer portions and upstream of a secondary transfer portion (a portion where the toner image on the intermediate transfer belt 105 is transferred onto a recording sheet S). Although the density sensors 1001*a* to 1001*d* and the density sensor 1002 are illustrated in FIG. 10, the density sensor 1002 is not necessary when the density sensors 1001*a* to 1001*d* are provided, and the density sensors 1001*a* to 1001*d* are not necessary when the density sensor 1002 is provided. The density sensor 1002 may be disposed downstream of the fixing device 107 in the conveyance direction of the recording sheet S to detect the density of toner image fixed on the recording sheet S.

Figure 11:
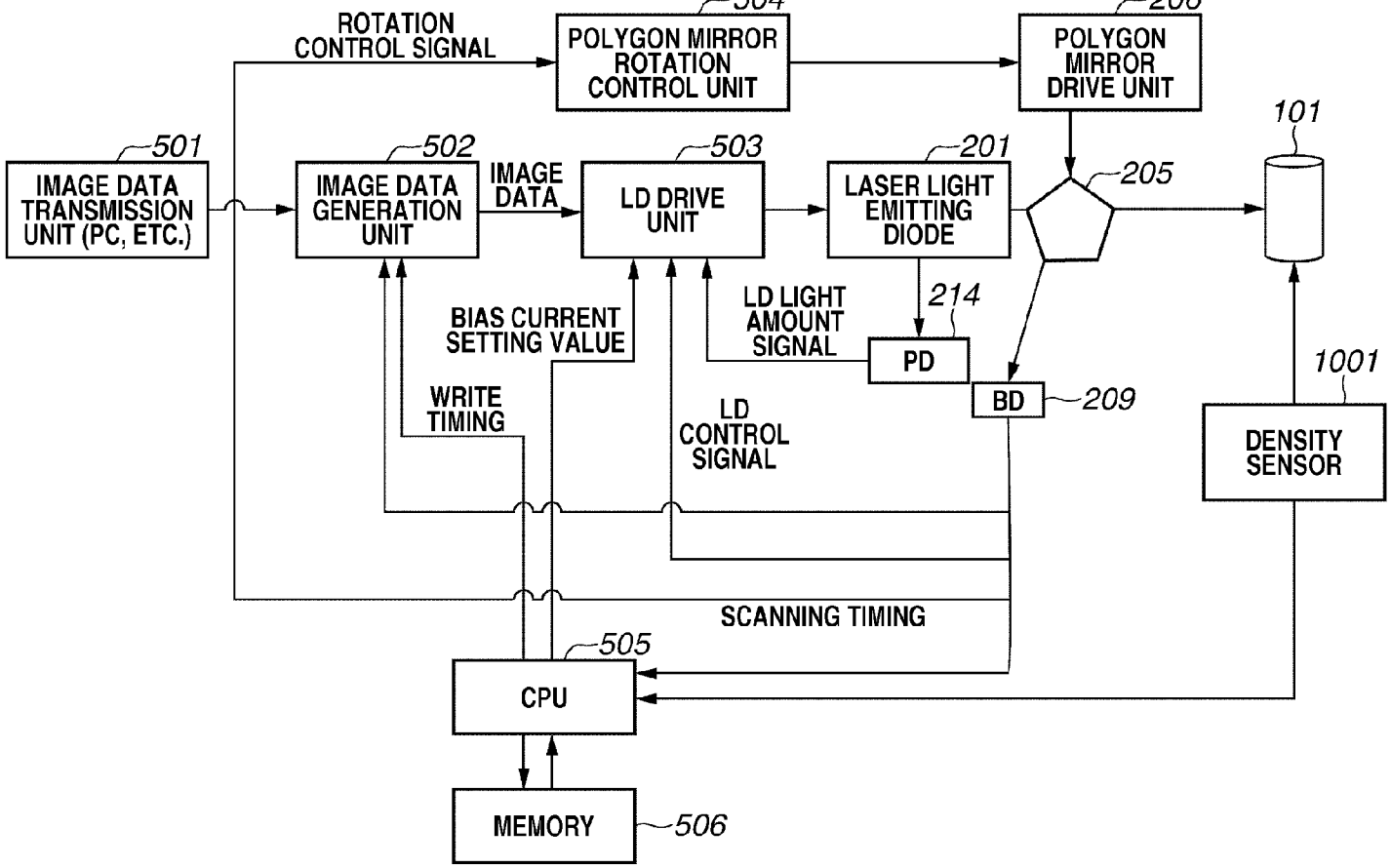
FIG. 11 is a control block diagram illustrating the image forming apparatus according to the second exemplary embodiment.

FIG. 11 is a control block diagram illustrating the image forming apparatus according to the present exemplary embodiment. Explanations of blocks having the same function as those in FIG. 5 will be omitted. The block diagram in FIG. 11 differs from the block diagram in FIG. 5 in that the potential sensor 212 is replaced with the density sensor 1001. Explanations of the density sensor 1002 will be omitted in the control block diagram in FIG. 11.

Figure 12:
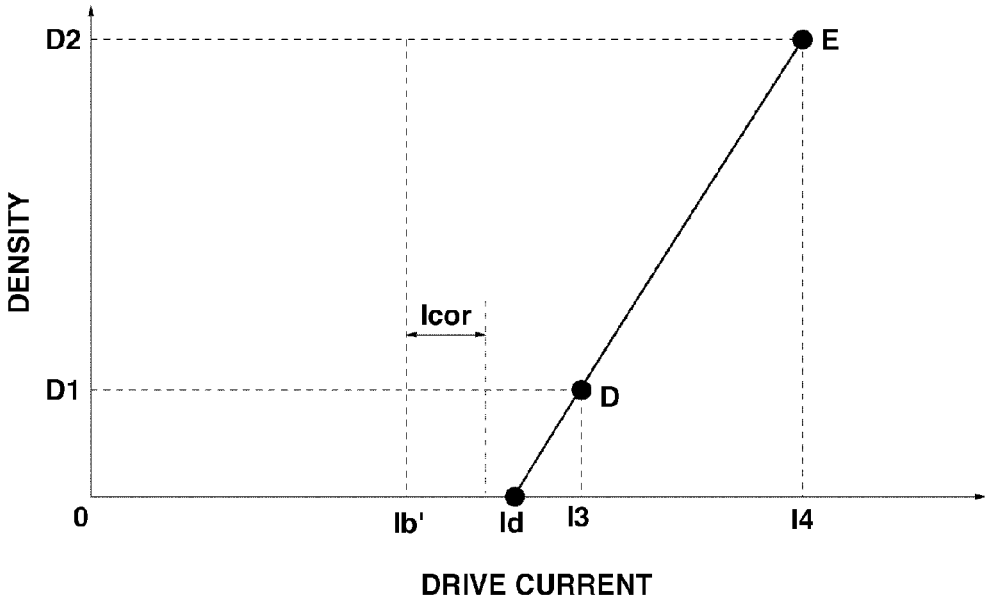
FIG. 12 illustrates a relation between a drive current value and the density of a developed toner image.

FIG. 12 illustrates a relation between a drive current value and the density of a developed toner image. The vertical axis is assigned the density of toner image and the horizontal axis is assigned the drive current value. Referring to FIG. 12, a point D is defined by the density of the first toner image developed from the first electrostatic latent image and the drive current value I3 described in the first exemplary embodiment, and a point E is defined by the density of the second toner image developed from the second electrostatic latent image and the drive current value I4 described in the first exemplary embodiment.

On the graph in FIG. 12, the CPU 505 obtains the drive current value Id for an intersection of a line segment extending from the straight line connecting the points D and E and the line segment for density zero. The CPU 505 multiplies a difference between the drive current value Id and the reference current value Ib' by a predetermined coefficient β ($0<\beta\leq 1$) to obtain the correction value Icor.

Figure 13:
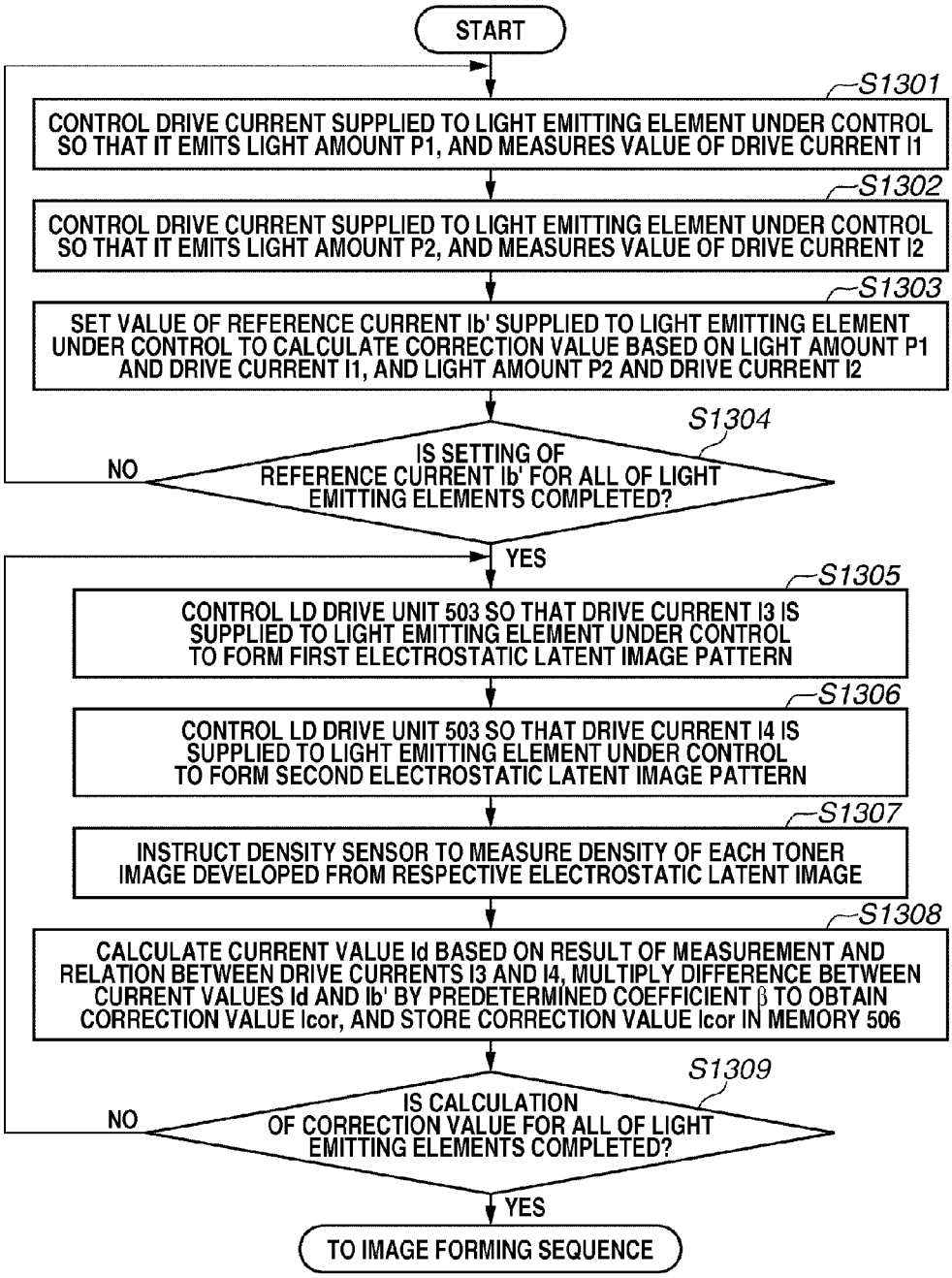
FIG. 13 is a flow chart illustrating control performed by the CPU to calculate a correction value.

The control flow performed by the CPU 505 will be described below with reference to FIG. 13. Steps S1301 to S1306 are similar to steps S601 to S606 and therefore explanations will be omitted.

In step S1307, the CPU 505 instructs the density sensors 1001*a* to 1001*d* to measure the density of respective toner images developed from electrostatic latent image patterns. In step S1308, the CPU 505 calculates the drive current value Id based on a result of density measurement and a relation between the drive currents I3 and I4, obtains a difference between the current values Id and the reference current value Ib', and stores the difference in the memory 506 as the correction value Icor for each light emitting element. In step S1309, the CPU 505 determines whether calculation of the correction value Icor is completed for all of the light emitting elements. When calculation of the correction value Icor is completed for all of the light emitting elements (YES in step S1309), the CPU 505 performs the image forming sequence. Otherwise, when calculation of the correction value Icor is not completed for all of the light emitting elements (NO in step S1309), the processing returns to step S1305 to calculate the correction value Icor for light emitting elements for which calculation of the correction value Icor is not completed.

Figure 16:
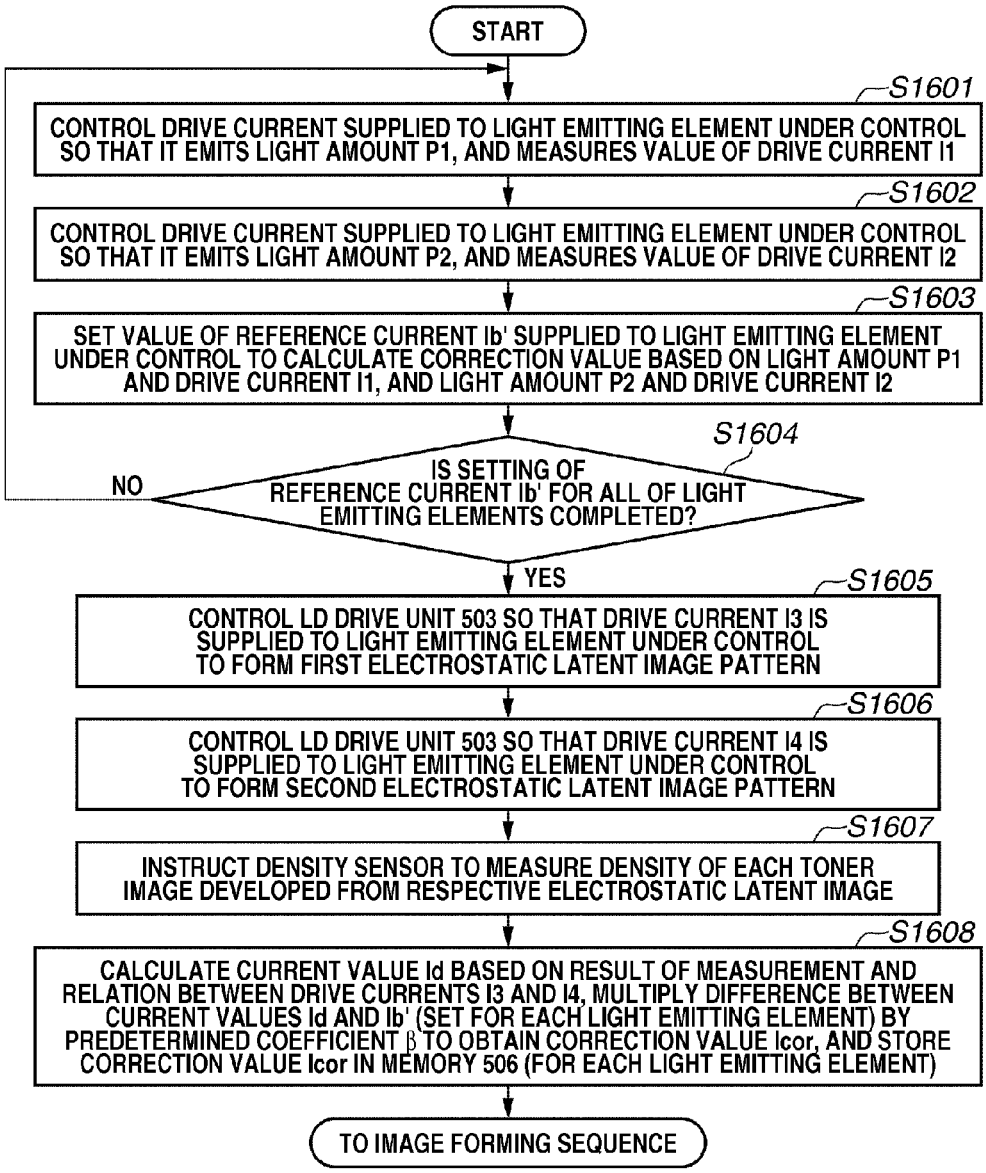
FIG. 16 is a flow chart illustrating exemplary other control performed by the CPU to calculate a correction value.

An exemplary control flow different from the control flow illustrated in FIG. 13 will be described below with reference to FIG. 16. In the control flow in FIG. 16, the electrostatic latent image patterns E1 and E2 are formed by using at least a plurality of light emitting elements, and then the drive current value Id for point A is calculated. Steps S1601 to S1604 are similar to steps S1301 to S1304 and, therefore, explanations will be omitted.

In step S1605, the CPU 505 controls the LD drive unit 503 to supply the drive current I3 to each light emitting element under control to form the electrostatic latent image pattern E1. In step S1606, the CPU 505 controls the LD drive unit 503 to supply the drive current I4 to each light emitting element under control to form the electrostatic latent image pattern E2. In step S1607, the CPU 505 instructs the potential sensors 212*a* to 212*d* to measure the potential of respective electrostatic latent images. In step S1608, the CPU 505 calculates the drive current value Id based on a result of potential measurement and a relation between the drive currents I3 and I4, multiplies a difference between the current values Id and the reference current value Ib' (set for each light emitting element in steps S1601 to S1603) by a predetermined coefficient β to obtain the correction value Icor, and stores the correction value Icor in the memory 506. Then, the processing proceeds to the image forming sequence.

As described above, the bias current value Ib can be controlled with high precision by controlling the bias current value Ib based on the density of toner images detected by the density sensors.

An image forming apparatus employing a background area exposing (BAE) method as a method for forming an electrostatic latent image on a photosensitive member is known. With an image forming apparatus employing the BAE method, a photosensitive drum is exposed to a laser beam and a toner image is formed at the charging potential portion where the charging potential remains unchanged, and not formed at the exposure potential portion where the charging potential has changed.

Since the surface potential characteristics of the photosensitive drum differ for each area thereon, the surface of the photosensitive drum is not charged to a uniform charging potential even when the surface is charged by an identical bias current. Therefore, there has been a problem of density nonuniformity in toner images.

A known image forming apparatus corrects the potential at the charging potential portion to a uniform charging potential. In this case, the charging potential portion is exposed to a laser beam having an intensity lower than a laser beam for forming an exposure potential portion. A memory of this image forming apparatus stores correction data corresponding to each area on the surface of the photosensitive drum. To correct the potential at the charging potential portion where a toner image is formed, the switching current Isw generated based on the correction data is superimposed on the bias current Ib to compose a drive current for driving a light emitting element. This enables restraining an uneven charging potential and accordingly reducing density nonuniformity in output images. This correction is referred to as shading correction.

With the image forming apparatus employing the BAE method, the switching current Isw generated based on the correction data for performing shading correction is minute in comparison with the switching current Isw for forming an exposure potential portion. With the bias current value Ib set to a value lower than the proper setting value, even when a drive current composed of the switching current Isw (generated based on the correction data) and the bias current Ib superimposed thereon is supplied to the light emitting element, the light emitting element does not emit a laser beam having such an intensity that changes the potential on the photosensitive drum. In such a case, shading correction will not sufficiently be performed. The present exemplary embodiment will be described below based on a case where the first and second exemplary embodiments are applied to an image forming apparatus employing the BAE method and having the shading correction function. First of all, shading correction will be described below.

Figure 17:
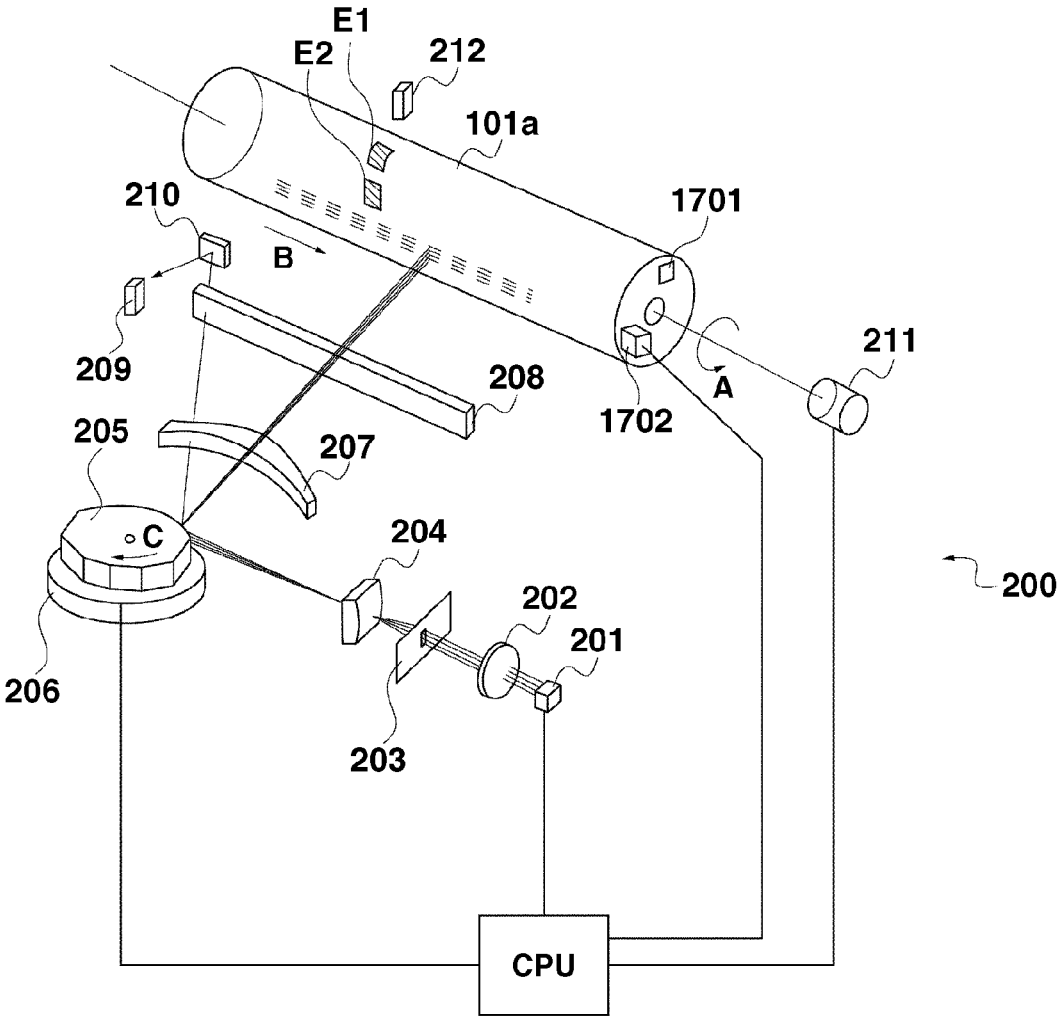
FIG. 17 is a schematic view illustrating an optical scanning apparatus and a photosensitive drum according to a third exemplary embodiment of the present invention.

FIG. 17 is a schematic view illustrating the optical scanning apparatus 200 and the photosensitive drum 101*a* according to the present exemplary embodiment. Elements having the same function as those in FIG. 2A are assigned the same reference numeral, and, therefore, explanations will be omitted. As illustrated in FIG. 17, the photosensitive drum 101*a* is provided with a reference mark 1701 for detecting a rotation reference position and a home position sensor 1702 (a rotation reference position detection unit) for detecting the reference mark 1701. The home position sensor 1702 generates a rotation reference signal each time the reference mark 1701 passes a detection point while the photosensitive drum 101*a* is rotating.

Figure 18:
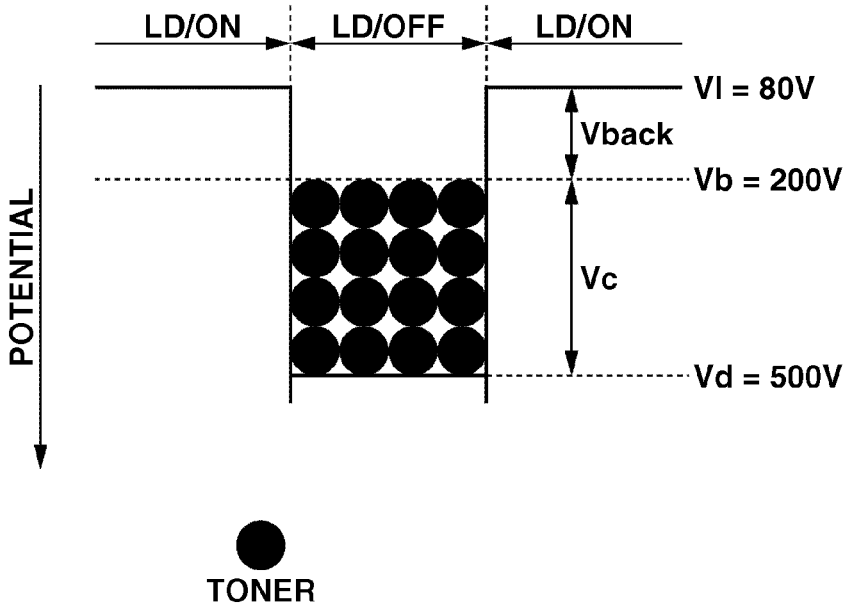
FIG. 18 illustrates a potential at an exposure potential portion and a charging potential portion on a photosensitive member when a background area exposing (BAE) method is applied.

The BAE method, which is an exposure method for the image forming apparatus according to the present exemplary embodiment, will be described below with reference to FIG. 18. FIG. 18 illustrates the potential on the photosensitive drum 101*a*. Referring to FIG. 18, LD/ON denotes a state where a light emitting element is turned ON by a drive current composed of the bias current Ib and the switching current Isw superimposed thereon, and LD/OFF denotes a state where the light emitting element is weakly turned ON only by the bias current Ib or turned OFF.

With the BAE method, the photosensitive drum 101*a* is charged to a potential Vd (500 V) by the respective charging device and then exposed to a laser beam emitted from a semiconductor laser in relation to image data, and the surface potential at the exposure potential portion is changed from the charging potential Vd to Vl, thus forming a latent image on the photosensitive drum 101*a*. In this case, two different portions (first and second potential portions) are formed on the surface of the photosensitive drum 101*a*. At the first potential portion, the surface potential is maintained to the charging potential Vd. At the second potential portion, the surface potential drops to Vl (80 V).

The respective development unit applies to toner the bias voltage Vb (200 V) which is 120 V (Vback) higher than Vl. Thus, toner adheres to a portion having a potential higher than Vb, i.e., a portion maintained to the charging potential Vd, but not to the exposure potential portion. The amount of adhering toner (the toner image density) is determined by a difference Vc between Vb and Vd, i.e., 300 V. Establishing the above-mentioned potential relation makes it possible to form the first and second potential portions on the photosensitive drum 101*a*. The first potential portion can form a toner image on a recording medium while the second potential portion cannot form a toner image thereon when the toner image is transferred thereto.

Figure 19A:
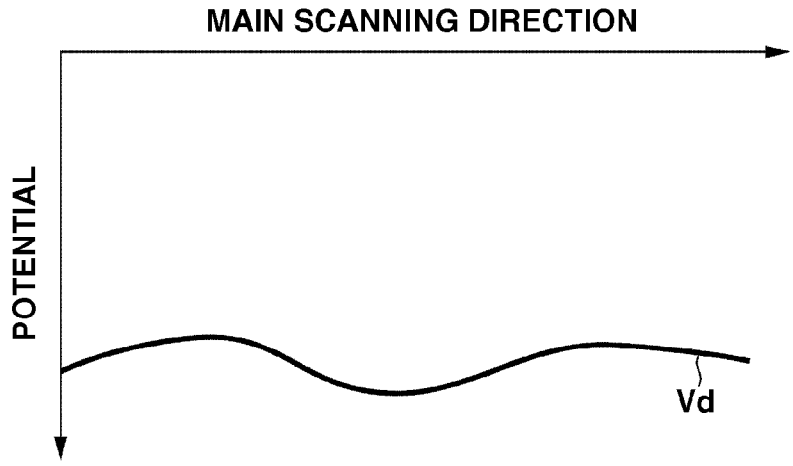
FIGS. 19A and 19B illustrate a concept of shading correction.
Figure 19B:
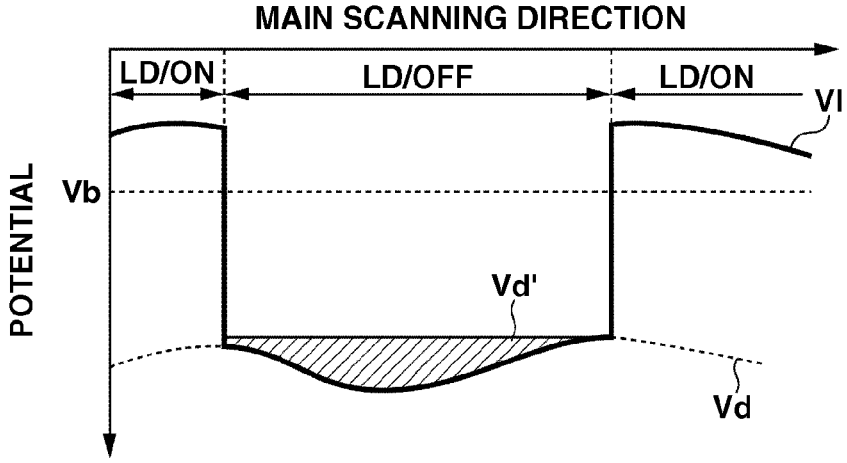

With the image forming apparatus employing the BAE method, setting the bias current value Ib to a value lower than a desired value causes the following problem. FIGS. 19A and 19B illustrate a concept of shading correction. The photosensitive drum 101*a* is charged by the respective charging device. Since the sensitivity of the photosensitive drum 101*a* differs for each area, a difference in charging potential Vd arises for each area on the photosensitive drum 101*a*, as illustrated in FIG. 19A. With the image forming apparatus employing the BAE method, this potential difference causes a difference in the amount of toner adhering to the charging potential portion illustrated in FIG. 18, thus producing density nonuniformity in images.

To correct the difference in charging potential, the image forming apparatus performs correction control (shading correction). Specifically, the photosensitive drum 101*a* is exposed to a weak (low-intensity) laser beam to uniform the charging potential at the first potential portion on the photosensitive drum 101*a* corresponding to a portion on the recording medium where a toner image is formed (refer to FIG. 19B). To perform shading correction, the surface of the photosensitive drum 101*a* is divided into a plurality of areas, and correction data (control data) corresponding to each division area is stored in a memory (described below), as illustrated in FIG. 5. The CPU 505 locates a position to be exposed to a laser beam emitted from the semiconductor laser, and reads correction data from the memory based on a result of location. The switching current Isw is generated based on the read correction data, and a drive current composed of the bias current Ib and the switching current Isw superimposed thereon is supplied to the semiconductor laser. Exposing a toner adhering portion to a weak (low-intensity) laser beam to change the light amount in this way restrains the difference in charging potential. As illustrated in FIG. 19B, the uneven charging potential Vd can be uniformed to Vd'.

The laser beam emitted at the time of shading correction has such a light amount that changes the charging potential (500 V) illustrated in FIG. 18 by several volts to several tens of volts. Therefore, it is necessary that the light amount of laser beam emitted from a light emitting element is weaker than the light amount of laser beam for forming on the photosensitive drum 101*a* such a potential portion (the second potential portion) that does not form a toner image on the recording medium. Therefore, the switching current Isw to be superimposed onto the bias current Ib at the time of shading correction is weaker than the switching current to be superimposed onto the bias current Ib to form on the photosensitive drum 101*a* such a potential portion that does not form a toner image on the recording medium.

Location of an exposure position is performed as follows. The home position sensor 1702 generates the rotation reference signal at a timing when the reference mark 1701 passes the detection point of the home position sensor 1702.

In a state where the photosensitive drum 101*a* is stably rotating at a constant rotational speed when forming an electrostatic latent image thereon, the CPU 505 starts counting the reference clock output from a built-in crystal oscillator at a timing when the home position sensor 1702 generates the rotation reference signal. The CPU 505 locates an exposure position in the subscanning direction (in the rotational direction of the photosensitive drum 101*a*) based on the count value. The CPU 505 starts counting the reference clock at a timing of BD signal generation. The CPU 505 locates an exposure position in the main scanning direction (in the rotational axis direction of the photosensitive drum 101*a*) based on the count value.

Figure 20:
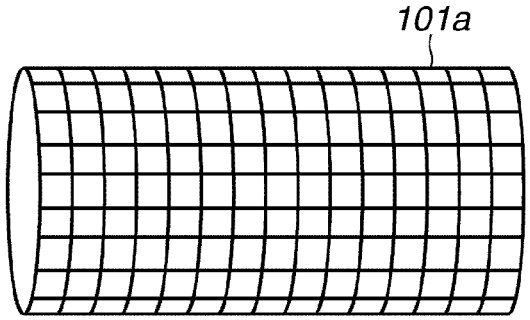
FIG. 20 illustrates the surface of the photosensitive drum divided into a plurality of areas.
Figure 20:
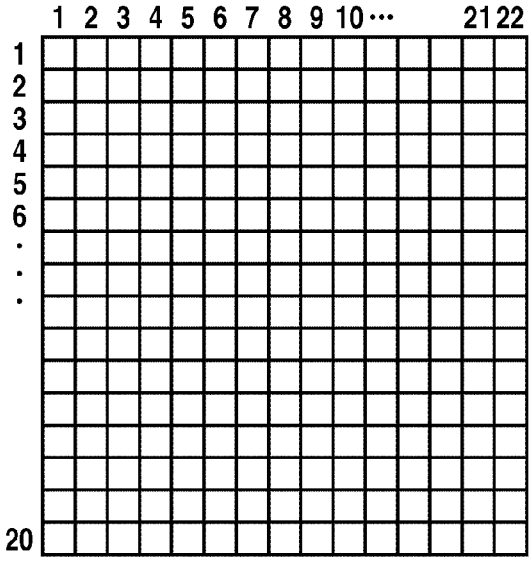

The present exemplary embodiment differs from the first and second exemplary embodiments in that the memory 506 of the image forming apparatus stores correction data associated with each of a plurality of division areas on the photosensitive drum 101*a*. Based on a result of location of the exposure position, correction data associated with each of a plurality of areas on the photosensitive drum 101*a* is read from the memory 506 as illustrated in FIG. 20, and then shading correction is performed based on the correction data.

However, with the bias current Ib set to a low value lower than the proper setting value as mentioned above, even when the switching current Isw for performing shading correction is superimposed on the bias current Ib, the light emitting element does not emit a laser beam having such an intensity that changes the potential on the photosensitive drum 101*a*. Thus, shading correction cannot sufficiently be performed and density nonuniformity arises in output images.

The image forming apparatus according to the present exemplary embodiment controls the bias current value Ib with high precision so that the bias current value Ib is not set to a low value that does not enable shading correction. To solve the above-mentioned problem, the image forming apparatus according to the present exemplary embodiment obtains the correction value Icor for correcting the reference current value Ib' calculated based on a result of light amount detection by the PD 214, corrects the bias current value Ib by using the correction value Icor, and sets the corrected value as the bias current value Ib. The method for setting the bias current Ib is similar to that in the first exemplary embodiment and therefore explanations will be omitted.

The image forming sequence (a sequence performed during one scan) performed by the CPU 505 in FIG. 5 will be described below. In the image forming sequence, the CPU 505 performs APC at a timing illustrated in FIG. 3 to calculate the reference current value Ib' for each light emitting element. The CPU 505 adds the correction value Icor stored in the memory 506 in step S608 in FIG. 6 to the reference current value Ib', and then sets the resultant value as the bias current value Ib. Then, the CPU 505 supplies the bias current value Ib to each light emitting element in the subsequent video region.

Figure 21:
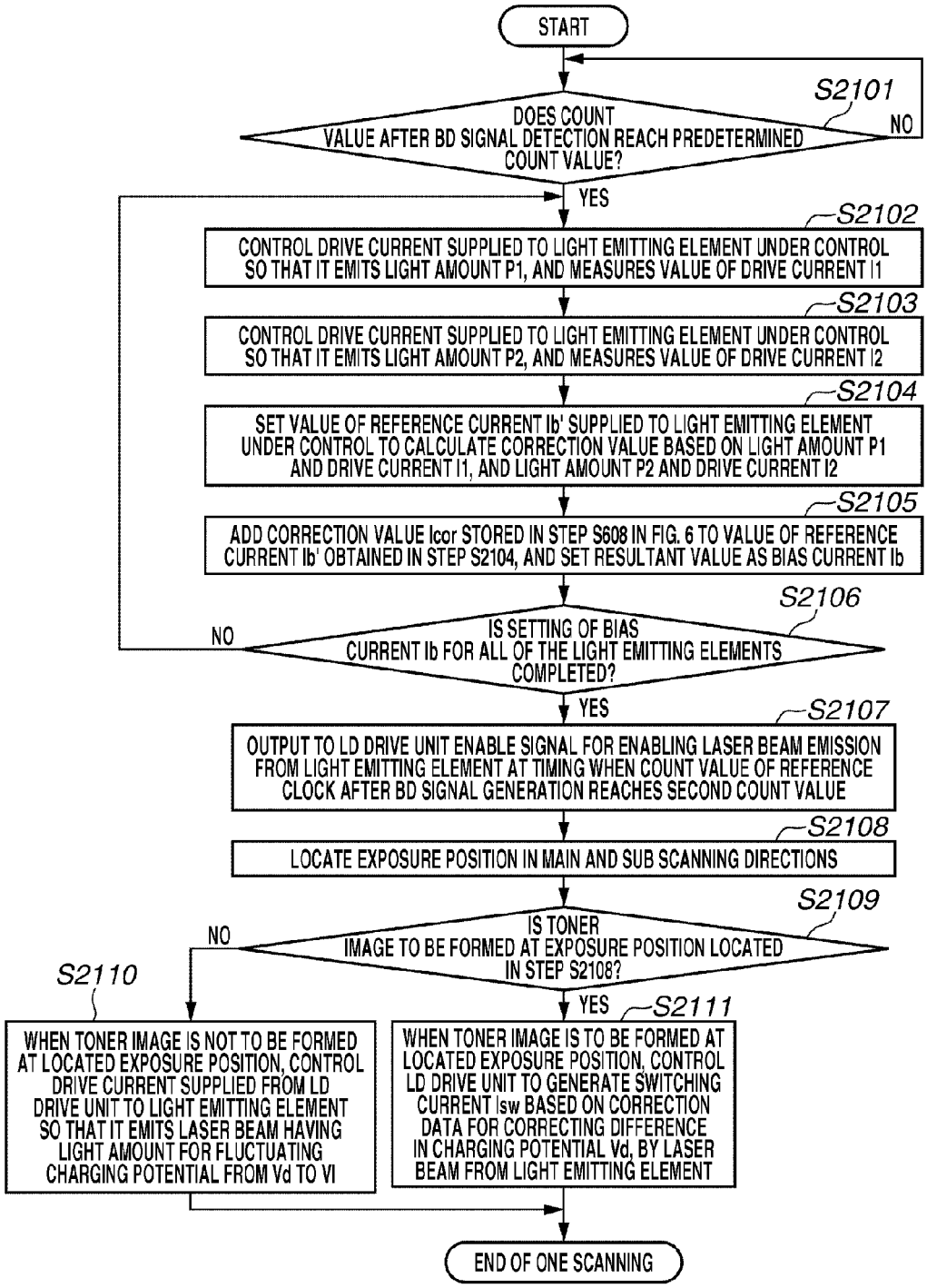
FIG. 21 is a flow chart illustrating exemplary control performed by the CPU of the image forming apparatus according to the third exemplary embodiment.

The control flow performed by the CPU 505 during the image-forming period will be described below with reference to FIG. 21. By using the above-mentioned method, the CPU 505 locates the position of a non-exposure potential portion on the photosensitive member, reads from the memory 506 correction data corresponding to the non-exposure potential portion, and transmits the correction data to the LD drive unit 503. The LD drive unit 503 generates the switching current Isw based on the input correction data, superimposes the switching current Isw on the bias current Ib to compose a drive current, and sends the drive current to the light emitting element. The bias current Ib may be corrected in all areas based on the correction data, without locating a non-exposure potential portion.

Shading correction is actually applied to a portion where a toner image is formed. Therefore, even a position on the recording medium where a toner image is formed is equivalent to an exposure position since that position is exposed to a weak laser beam. However, to simplify explanations, the present exemplary embodiment will be described below on an assumption that the non-exposure potential portion (the first potential portion) is a potential portion on the photosensitive drum 101*a* corresponding to a portion on the recording medium where a toner image is formed and that the exposure potential portion (the second potential portion) is a potential portion on the photosensitive drum 101*a* corresponding to a portion on the recording medium where a toner image is not formed.

In step S2101, the CPU 505 determines whether the count value of the reference clock after BD signal generation by the laser beam emitted from the light emitting element 213*d* has reached a predetermined count value (a first count value). The memory 506 stores the count value applicable to the non-image region as the predetermined count value. The laser beam scans the non-image region until the following BD signal is generated at a timing when the predetermined count value is reached. When the CPU 505 determines that the count value of the reference clock has reached the predetermined count value (YES in step S2101), the processing proceeds to step S2102. In step S2102, the CPU 505 supplies a current to the light emitting element under control so that it emits a laser beam having a light amount P1 illustrated in FIG. 15A, and measures the value of the drive current I1. In step S2103, the CPU 505 supplies a current to the light emitting element under control so that it emits a laser beam having a light amount P2 illustrated in FIG. 15A, and measures the value of the drive current I2. In step S2104, the CPU 505 sets the reference current value Ib' to be supplied to the light emitting element under control to calculate the correction value Icor based on the light amount P1 and the drive current I1, and the light amount P2 and the drive current I2.

In step S2105, the CPU 505 adds the correction value Icor stored in step S608 in FIG. 6 to the reference current value Ib', and sets the resultant value as the bias current Ib. In step S2106, the CPU 505 determines whether setting of the bias current Ib is completed for all of the light emitting elements. When setting of the bias current Ib is completed for all of light emitting elements (YES in step S2106), the processing proceeds to the image forming sequence. Otherwise, when setting of the bias current Ib is not completed for all of the light emitting elements (NO in step S2106), the processing returns to step S2102 to set the bias current Ib for light emitting elements for which setting of the bias current value Ib is not completed.

The BD signal is generated when APC is performed for the light emitting element 213*d*. In step S2107, at a timing when the count value of the reference clock after BD signal generation has reached the second count value, the CPU 505 outputs to the LD drive unit 503 an enable signal for enabling laser beam emission from light emitting element. The period after the LD drive unit 503 inputs the enable signal is a period during which the image region is scanned. In step S2108, in the image region, the CPU 505 locates an exposure position of the laser beam in the main and sub scanning directions depending on a plurality of count values counted based on the output from the home position sensor 1702 and the output of the BD signal. In step S2109, the CPU 505 determines whether a toner image is to be formed at the exposure position located in step S2108. When a toner image is not to be formed at the located exposure position (NO in step S2109), the processing proceeds to step S2110. In step S2110, the CPU 505 controls the drive current supplied from the LD drive unit 503 to the light emitting element so that it emits a laser beam having such a light amount that changes the charging potential from Vd to Vl. Otherwise, when a toner image is to be formed at the located exposure position (YES in step S2109), the processing proceeds to step S2111. In step S2111, the CPU 505 controls the LD drive unit 503 to generate the switching current Isw based on the correction data for correcting the difference in charging potential Vd by using a laser beam from the light emitting element. The LD drive unit 503 supplies to the light emitting element a drive current composed of the bias current Ib and the switching current Isw (controlled by the LD drive unit 503) superimposed thereon. This completes one scanning.

As mentioned above, the bias current value Ib can be controlled to be set to a value less than and close to the minimum value of the drive current value necessary to form an electrostatic latent image on the photosensitive drum 101*a*. Accordingly, even if a switching current for emitting a minute amount of light is supplied to a light-emitting element to perform the potential correction (shading correction) of a charging potential portion, such a phenomenon can be prevented that an intense laser beam capable of varying the potential of the photosensitive drum 101*a* cannot be emitted. The present exemplary embodiment has specifically been described based on a case where the correction value Icor is calculated by using the potential sensor 212. However, the correction value Icor may be calculated by using the density sensors 1001*a* to 1001*d*, as described in the second exemplary embodiment.

Aspects of the present invention can also be realized by a computer of a system or apparatus (or devices such as a CPU or MPU) that reads out and executes a program recorded on a memory device to perform the functions of the above-described embodiment (s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-051869 filed Mar. 9, 2010, No. 2010-053408 filed Mar. 10, 2010, and No. 2011-015343 filed Jan. 27, 2011, which are hereby incorporated by reference herein in their entirety.

What is claimed is:

1. An image forming apparatus comprising:

a photosensitive member;

a charging unit configured to charge the photosensitive member;

a light source configured to emit a light beam for exposing the charged photosensitive member, wherein the light source includes a plurality of light emitting elements;

a current supply unit configured to supply a drive current to the light source to cause the light source to emit the light beam, wherein the drive current includes a bias current;

a light receiving unit configured to receive a light beam emitted by any one of the light emitting elements to which the drive current is supplied and a light beam emitted by a light emitting element, to which the bias current is supplied, other than the any one of the light emitting elements;

a potential detection unit configured to detect a potential of the photosensitive member; and a control unit configured to control a value of the bias current, wherein the control unit controls the light source such that a plurality of the electrostatic latent pattern images, of which a potential is different to each other and is different to a charging potential of the photosensitive member charged by the charging unit, is formed on the photosensitive member, and the control unit controls the bias current supplied to the any one of the light emitting elements based on an amount of light which the light receiving unit receives and a relationship between the charging potential and the potentials of the plurality of the electrostatic latent pattern images detected by the detection unit.

2. The image forming apparatus according to claim 1, wherein the current supply unit supplies to the plurality of light emitting elements of the light source a first drive current for forming a first electrostatic latent image and a second drive current, different in current value from the first drive current, for forming a second electrostatic latent image, and wherein the relationship includes a relationship among the charging potential, a relationship between a value of the first drive current and a potential of the first electrostatic latent image, and a relationship between a value of the second drive current and a potential of the second electrostatic latent image.

3. The image forming apparatus according to claim 2, wherein the bias current enables emitting the light beam so as to have a light amount that does not change the charging potential of the photosensitive member, and wherein the control unit increases the value of the bias current to be supplied to the plurality of light emitting elements by the current supply unit so that the bias current comes close to a minimum value of the drive current for emitting a light beam having a light amount that changes the potential of the photosensitive member.

4. The image forming apparatus according to claim 1, wherein the control unit obtains a reference current value based on the amount of light received by the light receiving unit, and corrects the reference current value based on the potential detected by the potential detection unit, to determine the value of the bias current.

5. The image forming apparatus according to claim 1, further comprising:

a position detection unit configured to detect an exposure position on the photosensitive member formed with the light beam; and a storage unit configured to store correction data for changing a light amount of the light beam emitted from the light source according to the exposure position, wherein the control unit controls the drive current based on image data so that a light beam having such a light amount that changes the potential of the photosensitive member is emitted to a position on the photosensitive member where an electrostatic latent image is not to be formed, and controls the drive current not to change the potential of the photosensitive member for a position on the photosensitive member where an electrostatic latent image is to be formed, and wherein the current supply unit supplies to the light source a drive current generated based on the correction data.

6. The image forming apparatus according to claim 1, wherein the bias current enables emitting the light beam so as to have a light amount that does not change a potential of the photosensitive member.

7. The image forming apparatus according to claim 1, wherein the current supply unit is configured to supply the bias current to the any one of the light emitting elements during forming an image and to supply the drive current composed of the bias current and a switching current superimposed thereon to the any one of the light emitting elements based on the image data.

8. An image forming apparatus comprising:

a photosensitive member;

a charging unit configured to charge the photosensitive member;

a light source configured to emit a light beam for exposing the charged photosensitive member, wherein the light source includes a plurality of light emitting elements;

a light receiving unit configured to receive a light beam emitted by any one of the light emitting elements to which the drive current is supplied and a light beam emitted by a light emitting element, to which the bias current is supplied, other than the any one of the light emitting elements;

a potential detection unit configured to detect a potential of the photosensitive member; and a reference current setting unit configured to set a value of a reference current based on an amount of light which the light receiving unit receives;

a correction current setting unit configured to set a value of a correction current to correct the reference current, wherein the correction current setting unit controls the light source such that a plurality of the electrostatic latent pattern image, of which a potential is different to each other and is different to a charging potential of the photosensitive member charged by the charging unit, is formed on the photosensitive member, and set the value of the correction current based on a relationship between the charging potential and the potentials of plurality of the electrostatic latent pattern image detected by the detection unit; and a current supply unit configured to supply a bias current composed of the reference current, a value of which is set by the reference current setting unit, and the correction current, a value of which is set by the correction current setting unit, superimposed thereon to the any one of the light emitting elements.

9. The image forming apparatus according to claim 8, wherein the current supply unit is configured to supply the bias current to the any one of the light emitting elements during forming an image and to supply the drive current composed of the bias current and a switching current superimposed thereon to the any one of the light emitting elements based on the image data.

10. The image forming apparatus according to claim 8 further comprising;

a storage unit configured to store the value of the correction current set by the correction current setting unit, wherein the correction current setting unit is configured to set the value of the correction current before an image is formed based on the image data, and to cause the storage unit to store the value of the correction current set by the correction current setting unit, and wherein the reference current setting unit is configured to set the value of the reference current during a period other than a period during which the photosensitive member is scanned with the light beams emitted from the light source.

11. The image forming apparatus according to claim 10 further comprising;

a polygon mirror configured to deflect the light beams emitted from the light source such that the light beams deflected by the polygon mirror scans the photosensitive member, wherein the reference current setting unit is configured to cause the any one of the light emitting elements to emit the light beams so that the light beams have plural amounts of light during a period except for a period when the photosensitive member is scanned with the light beams emitted from the light source based on the image data, and to set the reference current based on a relationship between the plural amounts of light to be detected by the detection unit and drive currents respectively corresponding to the plural amounts of light.

12. The image forming apparatus according to claim 8, wherein the correction current setting unit cause the current supply unit to supply to the plurality of light emitting elements of the light source a first drive current for forming a first electrostatic latent image and a second drive current, different in current value from the first drive current, for forming a second electrostatic latent image, and wherein the relationship includes a relationship among the charging potential, a relationship between a value of the first drive current and a potential of the first electrostatic latent image, and a relationship between a value of the second drive current and a potential of the second electrostatic latent image.

* * * * *